US008428958B2

(12) United States Patent
Sung et al.

(10) Patent No.: US 8,428,958 B2
(45) Date of Patent: Apr. 23, 2013

(54) APPARATUS AND METHOD OF ENCODING AND DECODING SIGNALS

(75) Inventors: Ho-sang Sung, Yongin-si (KR); Eun-mi Oh, Seongnam-si (KR); Jung-hoe Kim, Seongnam-si (KR); Ki-hyun Choo, Seoul (KR); Mi-young Kim, Hwaseong-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 1038 days.

(21) Appl. No.: 12/246,570

(22) Filed: Oct. 7, 2008

(65) Prior Publication Data

US 2009/0210234 A1 Aug. 20, 2009

(30) Foreign Application Priority Data

Feb. 19, 2008 (KR) ..... 10-2008-0014909

(51) Int. Cl.
*G10L 19/00* (2006.01)

(52) U.S. Cl.
USPC ..... 704/500; 704/503; 704/268; 704/203; 704/200.1; 700/94; 381/20; 381/17; 381/12; 379/202.01; 375/316

(58) Field of Classification Search ..... 704/503, 704/268, 200.1, 500, 203; 700/94; 381/20, 381/17, 12; 379/202.01; 375/316
See application file for complete search history.

(56) References Cited

U.S. PATENT DOCUMENTS

| | | | | |
|---|---|---|---|---|
| 7,668,722 | B2 * | 2/2010 | Villemoes et al. | 704/500 |
| 8,019,087 | B2 * | 9/2011 | Goto et al. | 381/17 |
| 8,082,157 | B2 * | 12/2011 | Pang et al. | 704/500 |
| 2003/0236583 | A1 * | 12/2003 | Baumgarte et al. | 700/94 |
| 2006/0140412 | A1 * | 6/2006 | Villemoes et al. | 381/12 |
| 2006/0165237 | A1 * | 7/2006 | Villemoes et al. | 381/20 |
| 2006/0195314 | A1 * | 8/2006 | Taleb et al. | 704/200.1 |
| 2007/0002971 | A1 * | 1/2007 | Purnhagen et al. | 375/316 |
| 2007/0025538 | A1 * | 2/2007 | Jarske et al. | 379/202.01 |
| 2007/0094036 | A1 * | 4/2007 | Pang et al. | 704/503 |
| 2007/0208565 | A1 * | 9/2007 | Lakaniemi et al. | 704/268 |
| 2008/0120095 | A1 * | 5/2008 | Oh et al. | 704/203 |
| 2009/0248423 | A1 * | 10/2009 | Jung et al. | 704/500 |

* cited by examiner

*Primary Examiner* — Michael Colucci
(74) *Attorney, Agent, or Firm* — Stanzione & Kim, LLP

(57) ABSTRACT

A method of encoding an audio signal, where signals including two or more channel signals are downmixed to a mono signal, the mono signal is divided into a low-frequency signal and a high-frequency signal, the low-frequency signal is encoded through algebraic code excited linear prediction (ACELP) or transform coded excitation (TCX), and the high-frequency signal is encoded using the low-frequency signal. A method of decoding of an audio signal, a low-frequency signal encoded through ACELP or TCX is decoded, a high-frequency signal is decoded using the low-frequency signal, the low-frequency signal and the high-frequency signal are combined to generate a mono signal, and the mono signal is upmixed by decoding spatial parameters regarding signals including two or more channel signals.

8 Claims, 15 Drawing Sheets

APPARATUS AND METHOD OF ENCODING AND DECODING SIGNALS

CROSS-REFERENCE TO RELATED APPLICATIONS

This application claims priority under 35 U.S.C. §119(a) from Korean Patent Application No. 10-2008-0014909, filed on Feb. 19, 2008, in the Korean Intellectual Property Office, the disclosure of which is incorporated herein in its entirety by reference.

BACKGROUND OF THE INVENTION

1. Field of the Invention

One or more embodiments of the present general inventive concept relate to an apparatus and method of encoding or decoding an audio signal, such as a speech signal or a music signal, and more particularly, to an apparatus and method of encoding or decoding a plurality of signals including two or more channel.

2. Description of the Related Art

In AMR-WB+ (Extended Adaptive Multi-Bitrate Wideband), each of a left signal and a right signal is divided into a low-frequency signal and a high-frequency signal through a pre-processing unit/analysis filterbank. In this case, stereo encoding is performed by downmixing the left low-frequency signal and the right low-frequency signal to a mid signal and a side signal. The mid signal is encoded through algebraic code excited linear prediction (ACELP)/transform coded excitation (TCX). The left high-frequency signal and the right high-frequency signal are encoded through bandwidth extension (BWE). The resultant encoded signals are multiplexed into a bitstream and then the bitstream is transmitted to a decoding terminal. The decoding terminal receives the bitstream, and decodes it by performing the above process in a reverse manner.

SUMMARY OF THE INVENTION

One or more embodiments of the present general inventive concept include an apparatus and method of encoding or decoding a plurality of signals including two or more channel signals by using a parametric stereo method or a parametric multi-channel method.

Additional aspects and/or advantages of the present general inventive concept will be set forth in part in the description which follows and, in part, will be apparent from the description, or may be learned by practice of the general inventive concept.

The foregoing and/or other aspects and utilities of the present general inventive concept may be achieved by providing a signal encoding method including downmixing signals including two or more channel signals to a mono signal, and then extracting and encoding spatial parameters regarding the signals, dividing the mono signal into a low-frequency signal and a high-frequency signal, encoding the low-frequency signal through ACELP (algebraic code excited linear prediction) or TCX (Transform coded excitation), and encoding the high-frequency signal by using the low-frequency signal.

The foregoing and/or other aspects and utilities of the present general inventive concept may also be achieved by providing a signal decoding method including decoding a low-frequency signal encoded through ACELP(algebraic code excited linear prediction) or TCX (Transform coded excitation), decoding a high-frequency signal by using the decoded low-frequency signal, generating a mono signal by combining the low-frequency signal and the high-frequency signal, and upmixing the mono signal to a plurality of signals including two or more channel signals by decoding spatial parameters regarding the signals.

The foregoing and/or other aspects and utilities of the present general inventive concept may also be achieved by providing a bitstream generating method including encoding information regarding a bitrate or coding mode applied to encode a stereo signal, encoding an index representing an internal sampling frequency applied to a related frame, and encoding the stereo signal, a low-frequency signal, and a high-frequency signal.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
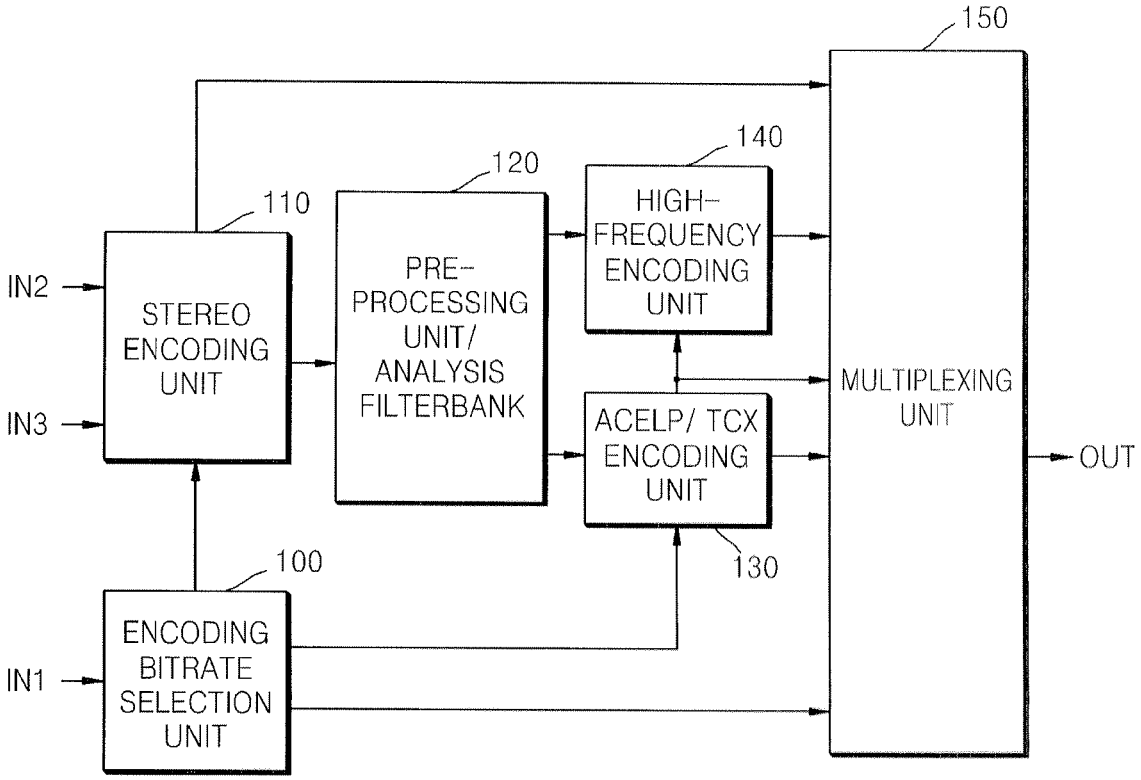
FIG. 1 (PRIOR ART)
FIG. 1 is a block diagram illustrating a signal encoding apparatus according to an embodiment of the present general inventive concept.

Reference will now be made in detail to embodiments of the present general inventive concept, examples of which are illustrated in the accompanying drawings, wherein like reference numerals refer to like elements throughout. In this regard, embodiments of the present general inventive concept may be embodied in many different forms and should not be construed as being limited to embodiments set forth herein. Accordingly, embodiments are merely described below, by referring to the figures, to explain the present general inventive concept.

A method and apparatus for encoding and decoding a signal according to embodiments of the present general inventive concept may be categorized according to a constant bitrate (CBR) method or a variable bitrate (VBR) method but are not limited thereto.

FIGS. 1, 3, 9, 10, 13, 14, 16, and 17 illustrate embodiments of the present general inventive concept supporting the CBR method.

In FIGS. 1, 3, 13 and 14, a whole bitrate applied to encoding each frame is fixed with respect to all frames. In particular, referring to FIGS. 1 and 13, a constant bitrate is equally allocated to all frames in order to encode each of a stereo signal and a low-frequency signal. However, referring to FIGS. 3 and 14, although the whole bitrate is equally and constantly (or fixedly) allocated to all frames, a bitrate at which each of a stereo signal and a low-frequency signal is encoded from among the whole bitrate is adaptively determined in units of frames.

Referring to FIGS. 9, 10, 16 and 17, a bitstream obtained by encoding frames at a constant bitrate is decoded. In particular, referring to FIGS. 9 and 16, a constant bitrate is equally allocated to all frames in order to decode each of a stereo signal and a low-frequency signal. However, referring to FIGS. 10 and 17, a bitstream encoded by equally and constantly (or fixedly) allocating the whole bitrate to all frames while adaptively determining a bitrate at which each of a stereo signal and a low-frequency signal are encoded, in units of frames.

Second, FIGS. 3, 5, 10, 11, 12, 14, 15, 17, 18 and 19 illustrate embodiments of the present general inventive concept supporting the VBR method.

In FIGS. 3, 5, 14 and 15, the whole bitrate allocated in order to encode a frame is changed in units of frames. In FIGS. 3, 5, 14 and 15, a bitrate at which each of a stereo signal and a low-frequency signal is encoded from among the whole bitrate is adaptively determined in units of frames. However, a stereo signal is encoded at a multi-bitrate referring to FIGS. 3 and 14 but is encoded at a variable bitrate referring to FIGS. 5 and 15.

In FIGS. 10, 11, 12, 17, 18 and 19, a bitstream encoded by changing the whole bitrate allocated in order to encode a frame in units of frames, is decoded. Referring to FIGS. 10, 11, 12, 17, 18 and 19, a bitstream encoded by adaptively determining a bitrate at which each of a stereo signal and a low-frequency signal is encoded, in units of frames from among the whole variable bitrate allocated to each frame, is decoded. However, a stereo signal is decoded at a multi-bitrate referring to FIGS. 10 and 17 but is decoded at a variable bitrate referring to FIGS. 11, 12, 18 and 19.

FIG. 1 is a block diagram illustrating a signal encoding apparatus according to an embodiment of the present general inventive concept. Referring to FIG. 1, the signal encoding apparatus includes an encoding bitrate selection unit 100, a stereo encoding unit 110, a pre-processing unit/analysis filterbank 120, an algebraic code excited linear prediction (ACELP)/transform coded excitation (TCX) encoding unit 130, a high-frequency encoding unit 140, and a multiplexing unit 150. The signal encoding apparatus illustrated in FIG. 1 supports the CBR method in which encoding is completely performed at a constant bitrate. In the current embodiment, a stereo signal and a low-frequency signal are encoded at a multi-bitrate.

A plurality of bitrates or coding modes to be allocated to encoding performed by the stereo encoding unit 110 or the ACELP/TCX encoding unit 130 are preset in the encoding bitrate selection unit 100. The encoding bitrate selection unit 100 selects a bitrate or coding mode from among the preset bitrates or coding modes according to a target bitrate input via an input terminal IN1, based on a predetermined criterion.

The stereo encoding unit 110 downmixes two channel signals received via input terminals IN2 and IN3 to a mono signal. For example, the two channel signals may be stereo signals including a left signal and a right signal. However, the present general inventive concept is not limited thereto, and multi-channel signals, i.e., three or more channel signals, may be received.

The stereo encoding unit 110 also generates a spatial parameter representing the relationship between the two channel signals and the mono signal. The spatial parameter may represent the difference between the energy levels of channels, or the correlation or coherence between the channels. The stereo encoding unit 110 encodes a stereo signal at a multi-bitrate, and thus generates the spatial parameter according to the bitrate or coding mode selected by the encoding bitrate selection unit 100.

The stereo encoding unit 110 allows AMR-WB+ (Extended Adaptive Multi-Bitrate Wideband) to efficiently encode a stereo signal or a multi-channel signal by applying a parametric stereo method or a parametric multi-channel method.

The pre-processing unit/analysis filterbank 120 divides the mono signal generated by the stereo encoding unit 110 into a low-frequency signal and a high-frequency signal. The pre-processing unit/analysis filterbank 120 may generate the low-frequency signal by downsampling the mono signal through low-pass filtering, and may generate the high-frequency signal by downsampling the mono signal through band-pass filtering.

The ACELP/TCX encoding unit 130 encodes the low-frequency signal generated by the pre-processing unit/analysis filterbank 120 by selecting ACELP encoding or TCX encoding in units of frames, based on a predetermined criterion. According to an embodiment of the present general inventive concept, a close-loop analysis-by-synthesis method may be used in order to allow the ACELP/TCX encoding unit 130 to select ACELP encoding or TCX encoding. The ACELP/TCX encoding unit 130 encodes the low-frequency signal at a multi-bitrate, and thus, the low-frequency signal is encoded according to the bitrate or coding mode selected by the encoding bitrate selection unit 100.

Here, ACELP encoding may be performed in a similar manner to that performed by an AMR-WB speech codec, and may include long-term prediction (LTP) analysis and synthesis, and algebraic codebook excitation. ACELP encoding may be performed using 256-sample frames.

TCX encoding may be performed using a perceptually weighted signal in the transform domain. In this case, algebraic vector quantization may be performed on the perceptually weighted signal through split multi-bitrate lattice quantization. Transformation may be performed using 1024, 512 or 256 sample windows. An excitation signal may be restored by inversely filtering the quantized perceptually weighted signal with the same inverse weighting filter as in AMR-WB.

The high-frequency encoding unit 140 encodes the high-frequency signal generated by the pre-processing unit/analysis filterbank 120. The high-frequency encoding unit 140 may encode the high-frequency signal by either using the low-frequency signal or bandwidth extension (BWE) encoding a high-frequency signal at a low bitrate. In this case, the high-frequency encoding unit 140 can perform encoding by using, at least in part, a gain(s) or spectral envelope information. Also, the high-frequency encoding unit 140 can encode the high-frequency signal at a constant bitrate, unlike the stereo encoding unit 110 and the ACELP/TCX encoding unit 130.

The multiplexing unit 150 multiplexes the bitrate or coding mode selected by the encoding bitrate selection unit 100, the spatial parameter encoded by the stereo encoding unit 110, the low-frequency signal encoded by the ACELP/TCX encoding unit 130, and the high-frequency signal encoded by the high-frequency encoding unit 140 into a bitstream, and then outputs the bitstream via an output terminal OUT.

Figure 2:
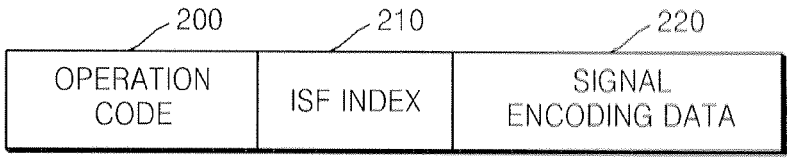
FIG. 2 is a conceptual diagram illustrating the syntax of a bitstream generated by the signal encoding apparatus of FIG. 1 according to an embodiment of the present general inventive concept.

FIG. 2 is a conceptual diagram illustrating the syntax of the bitstream generated by the multiplexing unit 150 according to an embodiment of the present general inventive concept. Referring to FIGS. 1 and 2, the bitstream may include operation code 200, an internal sample frequency (ISF) index 210, and signal encoding data 220.

7 bits may be allocated to the operation code 200. The operation code 200 contains information regarding the bitrate or coding mode selected by the encoding bitrate selection unit 100, which is allocated to encoding performed by the stereo encoding unit 110 and the ACELP/TCX encoding unit 130.

The ISF index 210 describes a predetermined internal sampling bitrate corresponding to each index. 5 bits are allocated to the ISF index 210 in order to represent an internal sampling frequency applied to each frame.

The signal encoding data 220 contains the spatial parameter encoded by the stereo encoding unit 110, data obtained by the ACELP/TCX encoding unit 130 encoding the low-frequency signal, and a parameter obtained by the high-frequency encoding unit 140 encoding the high-frequency signal.

Figure 3:
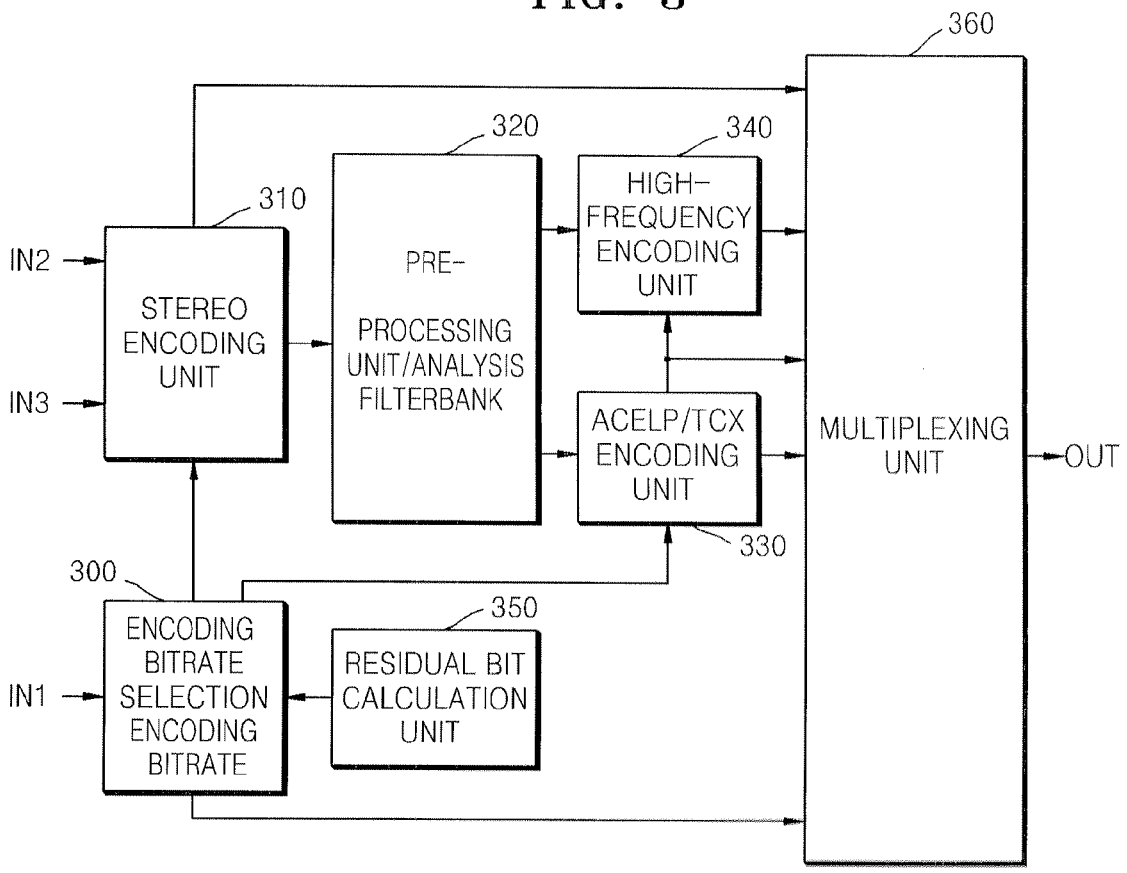
FIG. 3 is a block diagram illustrating a signal encoding apparatus according to another embodiment of the present general inventive concept.

FIG. 3 is a block diagram illustrating a signal encoding apparatus according to another embodiment of the present-general inventive concept. Referring to FIG. 3, the encoding apparatus includes an encoding bitrate selection unit 300, a stereo encoding unit 310, a pre-processing unit/analysis filterbank 320, an ACELP/TCX encoding unit 330, a high-frequency encoding unit 340, a residual bit calculation unit 350, and a multiplexing unit 360. In the current embodiment, both the CBR method in which encoding is completely and constantly (or fixedly) performed at a constant bitrate, and the VBR method in which encoding is performed at a variable bitrate while adaptively determining a bitrate in various ways may be used. In the encoding apparatus illustrated in FIG. 3, a stereo signal and a low-frequency signal are encoded at a multi-bitrate.

A plurality of bitrates or coding modes to be allocated to encoding performed by the stereo encoding unit 310 or the ACELP/TCX encoding unit 330 are preset in the encoding bitrate selection unit 300. The encoding bitrate selection unit 300 selects a bitrate or coding mode from among the predetermined bitrates or coding modes in consideration of a target bitrate input via an input terminal IN1 and residual bits calculated by the residual bit calculation unit 350, based on a predetermined criterion.

The stereo encoding unit 310 downmixes two channel signals received via input terminals IN2 and IN3 to a mono signal. For example, the two channel signals may be stereo signals, e.g., a left signal and a right signal. However, the present general inventive concept is not limited thereto, and multi-channel signals, i.e., three or more channel signals, may be received.

The stereo encoding unit 310 also generates a spatial parameter representing the relationship between the two channel signals and the mono signal. The spatial parameter may represent the difference between the energy levels of channels, or the correlation or coherence between the channels. The stereo encoding unit 310 encodes a stereo signal at a multi-bitrate, and thus generates the spatial parameter according to the bitrate or coding mode selected by the encoding bitrate selection unit 300.

The stereo encoding unit 310 allows AMR-WB+ to efficiently encode a stereo signal or a multi-channel signal by applying a parametric stereo method or a parametric multi-channel method.

The pre-processing unit/analysis filterbank 320 divides the mono signal generated by the stereo encoding unit 310 into a low-frequency signal and a high-frequency signal. The pre-processing unit/analysis filterbank 120 may generate the low-frequency signal by downsampling the mono signal through low-pass filtering, and may generate the high-frequency signal by downsampling the mono signal through band-pass filtering.

The ACELP/TCX encoding unit 330 encodes the low-frequency signal generated by the pre-processing unit/analysis filterbank 320 by selecting ACELP encoding or TCX encoding in units of frames, based on a predetermined criterion. According to an embodiment of the present general inventive concept, the close-loop analysis-by-synthesis method may be used in order to allow the ACELP/TCX encoding unit 330 to select ACELP encoding or TCX encoding. The ACELP/TCX encoding unit 330 encodes the low-frequency signal at a multi-bitrate, and thus, the low-frequency signal is encoded according to the bitrate or coding mode selected by the encoding bitrate selection unit 300.

Here, ACELP encoding may be performed in a similar manner to that performed by the AMR-WB speech codec, and may include a long-term prediction (LTP) analysis and synthesis, and algebraic codebook excitation. ACELP encoding may be performed using 256-sample frames.

TCX encoding may be performed using a perceptually weighted signal in the transform domain. In this case, algebraic vector quantization may be performed on the perceptually weighted signal through split multi-bitrate lattice quantization. Transformation may be performed using 1024, 512 or 256 sample windows. An excitation signal may be restored by inversely filtering the quantized perceptually weighted signal with the same inverse weighting filter as in AMR-WB.

The high-frequency encoding unit 340 encodes the high-frequency signal generated by the pre-processing unit/analysis filterbank 320. The high-frequency encoding unit 340 may encode the high-frequency signal by either using the low-frequency signal or bandwidth extension (BWE) encoding a high-frequency signal at a low bitrate. In this case, the high-frequency encoding unit 340 can perform encoding by using, at least in part, a gain(s) or spectral envelope information. Also, the high-frequency encoding unit 340 can encode the high-frequency signal at a constant bitrate, unlike the stereo encoding unit 310 and the ACELP/TCX encoding unit 330.

The residual bit calculation unit 350 calculates residual bits, excluding bits used by the stereo encoding unit 310 to encode the spatial parameter, in order for the ACELP/TCX encoding unit 330 to encode the low-frequency signal, and for the high-frequency encoding unit 340 to encode the high-frequency signal.

The multiplexing unit 360 multiplexes the bitrate or coding mode selected by the encoding bitrate selection unit 300, the spatial parameter encoded by the stereo encoding unit 310, the result of encoding the low-frequency signal by the ACELP/TCX encoding unit 330, and the result of encoding the high-frequency signal encoded by the high-frequency encoding unit 340 into a bitstream, and then outputs the bitstream via an output terminal OUT.

Figure 4:
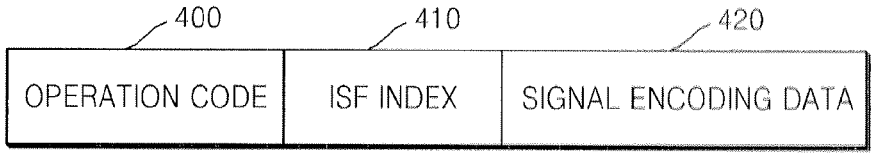
FIG. 4 is a conceptual diagram illustrating the syntax of a bitstream generated by the signal encoding apparatus of FIG. 3 according to an embodiment of the present general inventive concept.

FIG. 4 is a conceptual diagram of the syntax of the bitstream generated by the multiplexing unit 360 according to an embodiment of the present general inventive concept. Referring to FIGS. 3 and 4, the bitstream may include operation code 400, an ISF index 410, and signal encoding data 420.

7 bits may be allocated to the operation code 400. The operation code 400 contains information regarding the bitrate or coding mode selected by the encoding bitrate selection unit 300, which is allocated to encoding performed by the stereo encoding unit 310 and ACELP/TCX encoding unit 330.

The ISF index 410 describes a predetermined internal sampling bitrate corresponding to each index. 5 bits are allocated to the ISF index 410 in order to represent an internal sampling frequency applied to each frame.

The signal encoding data 420 contains a spatial parameter encoded by the stereo encoding unit 310, data obtained by the ACELP/TCX encoding unit 330 encoding the low-frequency signal, and a parameter obtained by the high-frequency encoding unit 340 encoding the high-frequency signal.

Figure 5:
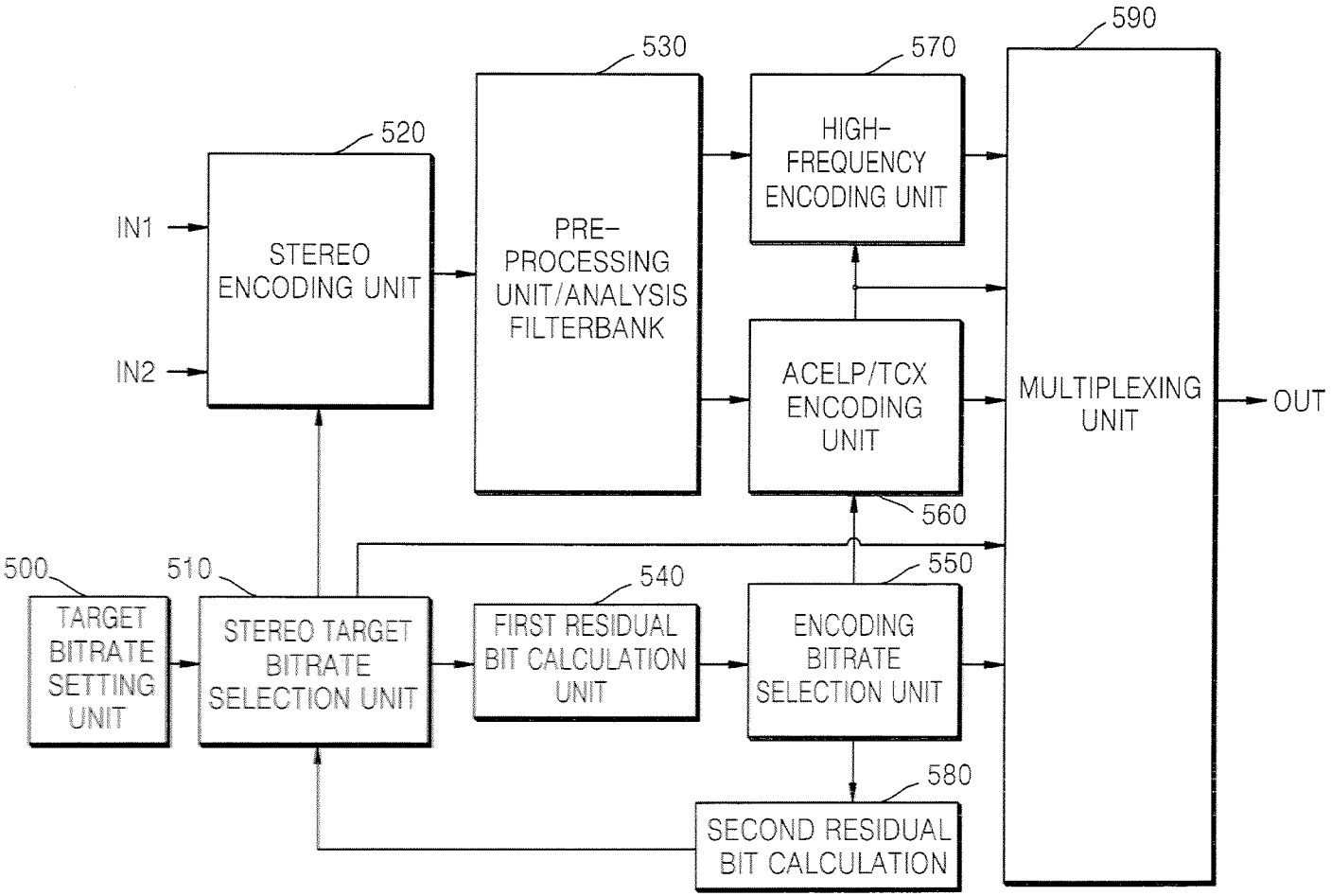
FIG. 5 is a block diagram illustrating a signal encoding apparatus according to another embodiment of the present general inventive concept.

FIG. 5 is a block diagram illustrating a signal encoding apparatus according to another embodiment of the present general inventive concept. Referring to FIG. 5, the signal encoding apparatus includes a target bitrate setting unit 500, a stereo target bitrate selection unit 510, a stereo encoding unit 520, a pre-processing unit/analysis filterbank 530, a first residual bit calculation unit 540, a encoding bitrate selection unit 550, an ACELP/TCX encoding unit 560, a high-frequency encoding unit 570, a second residual bit calculation unit 580, and a multiplexing unit 590. The signal encoding apparatus illustrated in FIG. 5 supports the VBR method in which encoding is performed at a variable bitrate while adaptively determining a bitrate. In the current embodiment, a stereo signal is encoded at a variable bitrate and a low-frequency signal is encoded at a multi-bitrate.

The target bitrate setting unit 500 sets a target bitrate allocated to encode a predetermined frame.

The stereo target bitrate selection unit 510 determines a target bitrate for encoding a stereo signal in consideration of the target bitrate set by the target bitrate setting unit 500 and residual bits calculated by the residual bit calculation unit 580, and then selects a stereo coding mode from among a plurality of stereo coding modes set to correspond to a plurality of maximum stereo encoding bitrates, based on the determined target bitrate according to a predetermined criterion.

The stereo encoding unit 520 downmixes two channel signals received via input terminals IN1 and IN2 to a mono signal. For example, the two channel signals may be stereo signals, e.g., a left signal and a right signal. However, the present general inventive concept is not limited thereto, and multi-channel signals, i.e., three or more channel signals, may be received.

The stereo encoding unit 520 also generates a spatial parameter representing the relationship between the two channel signals and the mono signal. The spatial parameter may represent the difference between the energy levels of channels, or the correlation or coherence between the channels.

The stereo encoding unit 520 encodes a stereo signal at a variable bitrate, and thus generates the spatial parameter according to the coding mode selected by the stereo target bitrate selection unit 510 in units of frames.

The stereo encoding unit 520 allows AMR-WB+ to efficiently encode a stereo signal or a multi-channel signal by applying the parametric stereo method or the parametric multi-channel method.

The pre-processing unit/analysis filterbank 530 divides the mono signal generated by the stereo encoding unit 520 into a low-frequency signal and a high-frequency signal. The pre-processing unit/analysis filterbank 530 may generate the low-frequency signal by downsampling the mono signal through low-pass filtering, and may generate the high-frequency signal by downsampling the mono signal through band-pass filtering.

The first residual bit calculation unit 540 calculates residual bits remaining after the stereo encoding unit 520 encodes the stereo signal, from among target bitrates set by the target bitrate setting unit 500.

The stereo target bitrate selection unit 510 or the first residual bit calculation unit 540 makes it possible to provide a signal for efficient encoding or to determine a bitrate or coding mode when encoding a stereo signal or a multi-channel signal by applying the parametric stereo method or the parametric multi-channel method.

A plurality of bitrates or coding modes to be allocated to encoding performed by the ACELP/TCX encoding unit 560 are preset in the encoding bitrate selection unit 550. The encoding bitrate selection unit 550 selects a bitrate or coding mode in units of frames from among the predetermined bitrates or coding modes in consideration of the residual bits calculated by the first residual bit calculation unit 540, based on a predetermined criterion. For example, the encoding bitrate selection unit 550 detects a bitrate or coding mode closest to the residual bits calculated by the first residual bit calculation unit 540, from among a plurality of bitrates or coding modes that do not exceed the calculated residual bits.

The ACELP/TCX encoding unit 560 encodes the low-frequency signal generated by the pre-processing unit/analysis filterbank 530 by selecting ACELP encoding or TCX encoding in units of frames, based on a predetermined criterion. According to an embodiment of the present general inventive concept, the close-loop analysis-by-synthesis method may be used in order to allow the ACELP/TCX encoding unit 560 to select ACELP encoding or TCX encoding.

The ACELP/TCX encoding unit 560 encodes the low-frequency signal at a multi-bitrate, and thus, the low-frequency signal is encoded according to the bitrate or coding mode selected by the encoding bitrate selection unit 550.

Here, ACELP encoding may be performed in a similar manner to that performed by the AMR-WB speech codec, and may include the long-term prediction (LTP) analysis and synthesis, and algebraic codebook excitation. ACELP encoding may be performed using 256-sample frames.

TCX encoding may be performed using a perceptually weighted signal in the transform domain. In this case, algebraic vector quantization may be performed on the perceptually weighted signal through split multi-bitrate lattice quantization. Transformation may be performed using 1024, 512 or 256 sample windows. An excitation signal may be restored by inversely filtering the quantized perceptually weighted signal with the same inverse weighting filter as in AMR-WB.

The high-frequency encoding unit 570 encodes the high-frequency signal generated by the pre-processing unit/analysis filterbank 530. The high-frequency encoding unit 570 may encode the high-frequency signal by either using the low-frequency signal or bandwidth extension (BWE) encoding a high-frequency signal at a low bitrate. In this case, the high-frequency encoding unit 570 can perform encoding by using, at least in part, a gain(s) or spectral envelope information. Also, the high-frequency encoding unit 570 can encode the high-frequency signal at a constant bitrate.

The second residual bit calculation unit 580 calculates residual bits excluding bits used by the ACELP/TCX encoding unit 130 to encode the low-frequency signal and by the high-frequency encoding unit 570 to encode the high-frequency signal, from among the residual bits calculated by the first residual bit calculation unit 540.

The multiplexing unit 590 multiplexes the target bitrate set by the target bitrate setting unit 500, the bitrate or coding mode selected by the stereo target bitrate selection unit 510, the spatial parameter encoded by the stereo encoding unit 520, the bitrate or coding mode selected by the encoding bitrate selection unit 550, the result of the ACELP/TCX encoding unit 560 encoding the low-frequency signal, and the result of the high-frequency encoding unit 570 encoding the high-frequency signal, into a bitstream, and then outputs the bitstream via an output terminal OUT.

Figure 6:
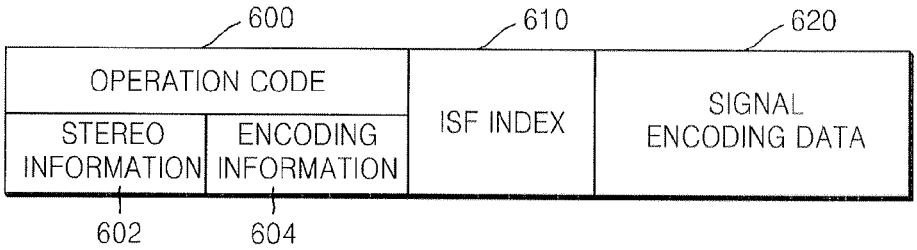
FIG. 6 is a conceptual diagram illustrating the syntax of a bitstream generated by the signal encoding apparatus of FIG. 5 according to an embodiment of the present general inventive concept.
Figure 7:
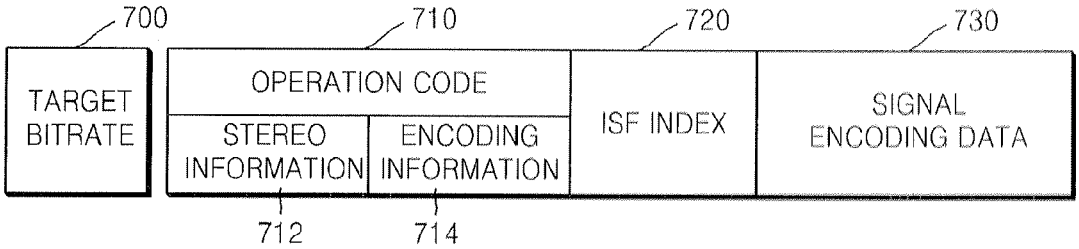
FIG. 7 is a conceptual diagram illustrating the syntax of a bitstream generated by the signal encoding apparatus of FIG. 5 according to another embodiment of the present general inventive concept.
Figure 8:
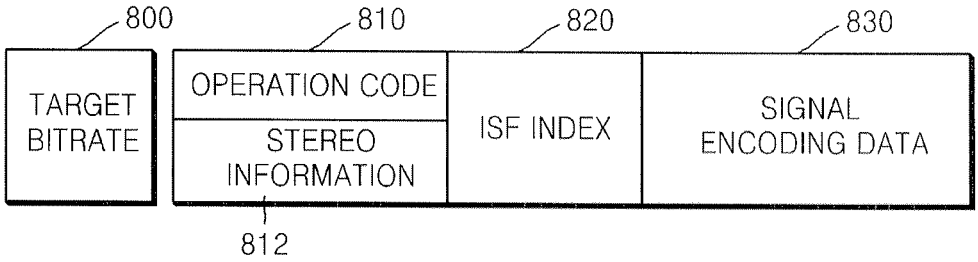
FIG. 8 is a conceptual diagram illustrating the syntax of a bitstream generated by the signal encoding apparatus of FIG. 5 according to another embodiment of the present general inventive concept.

FIGS. 6 through 8 are conceptual diagrams illustrating the syntax of the bitstream generated by the multiplexing unit 590 according to embodiments of the present general inventive concept.

According to an embodiment of the present general inventive concept, as illustrated in FIG. 6, the bitstream includes operation code 600, an ISF index 610, and signal encoding data 620. Referring to FIG. 6, information regarding bits being used at a variable bitrate and information regarding a coding mode used at a multi-bitrate are transmitted by including them in a header of the bitstream. The bits used at the variable bitrate include bits used to encode a stereo signal. The information regarding the coding mode used at the multi-bitrate includes information regarding a coding mode applied by the ACELP/TCX encoding unit 560 of FIG. 5 to encode a low-frequency signal.

The operation code 600 includes stereo information 602 regarding a bitrate or coding mode selected by the stereo target bitrate selection unit 510 of FIG. 5, and encoding information 604 regarding a bitrate or coding mode selected by the encoding bitrate selection unit 550 of FIG. 5.

The ISF index 610 describes a predetermined internal sampling bitrate corresponding to each index. 5 bits are allocated to the ISF index 610 in order to represent an internal sampling frequency applied to a related frame.

The signal encoding data 620 contains a spatial parameter encoded by the stereo encoding unit 520, data obtained by the ACELP/TCX encoding unit 560 encoding a low-frequency signal, and a parameter obtained by the high-frequency encoding unit 570 encoding a high-frequency signal.

The operation code 600, the ISF index 610 and the signal encoding data 620 are data transmitted in units of frames.

According to another embodiment of the present general inventive concept, as illustrated in FIG. 7, the bitstream includes a target bitrate 700, operation code 710, an ISF index 620, and signal encoding data 730. Referring to FIG. 7, the target bitrate 700 is first transmitted, and then, information regarding bits being used at a variable bitrate and information regarding a coding mode used at a multi-bitrate are additionally transmitted by including them in a header of the bitstream in units of frames. The information regarding the bits used at the variable bitrate includes information regarding bits used to encode a stereo signal. The information regarding the coding mode used at the multi-bitrate includes information regarding a coding mode applied by the ACELP/TCX encoding unit 560 of FIG. 5 to encode a low-frequency signal. The current embodiment may be applied when a bitrate or coding mode that is to be applied to encode a low-frequency signal is determined regardless of a bitrate or coding mode that is to be applied to encode a stereo signal.

The target bitrate 700 contains information on a target bitrate set by the target bitrate setting unit 500 in units of frames. The target bitrate 700 may be transmitted in units of frames but may be transmitted when, at least in part, there is a need to change the target bitrate 700.

The operation code 710 stereo information 712 regarding a bitrate or coding mode selected by the stereo target bitrate selection unit 510 of FIG. 5, and encoding information 714 regarding a bitrate or coding mode selected by the encoding bitrate selection unit 550 of FIG. 5.

The ISF index 720 describes a predetermined internal sampling bitrate corresponding to each index. 5 bits are allocated to the ISF index 720 in order to represent an internal sampling frequency applied to a related frame.

The signal encoding data 730 contains a spatial parameter encoded by the stereo encoding unit 520, data obtained by the ACELP/TCX encoding unit 560 encoding a low-frequency signal, and a parameter obtained by the high-frequency encoding unit 570 encoding a high-frequency signal.

The operation code 710, the ISF index 720, and the signal encoding data 730 are data transmitted in units of frames.

According to another embodiment of the present general inventive concept, as illustrated in FIG. 8, the bitstream includes a target bitrate 800, operation code 810, an ISF index 820 and signal encoding data 830. Referring to FIG. 8, the target bitrate 800 is first transmitted, and then, information regarding bits being used at a variable bitrate is additionally transmitted by being included in a header of the bitstream in units of frames. The information regarding the bits used at the variable bitrate includes information regarding bits used to encode a stereo signal. A coding mode used at a multi-bitrate may be determined not to exceed the result of subtracting the variable bitrate from the target bitrate 800 and to be closest to the result of subtracting. The current embodiment may be applied when encoding the other signals with residual bits remaining after subtracting bits used to encode a stereo signal from bits corresponding to the target bitrate 800.

The target bitrate 800 contains information on a target bitrate for each frame that is set by the target bitrate setting unit 500. The target bitrate 800 may be transmitted in units of frames but may be transmitted when, at least in part, there is a need to change the target bitrate 800.

The operation code 810 includes stereo information 812 regarding a bitrate or coding mode selected by the stereo target bitrate selection unit 510 of FIG. 5.

The ISF index 820 describes a predetermined internal sampling bitrate corresponding to each index. 5 bits are allocated to the ISF index 820 in order to represent an internal sampling frequency applied to a related frame.

The signal encoding data 830 contains a spatial parameter encoded by the stereo encoding unit 520, data obtained by the ACELP/TCX encoding unit 560 encoding a low-frequency signal, an a parameter obtained by the high-frequency encoding unit 570 encoding a high-frequency signal.

Figure 9:
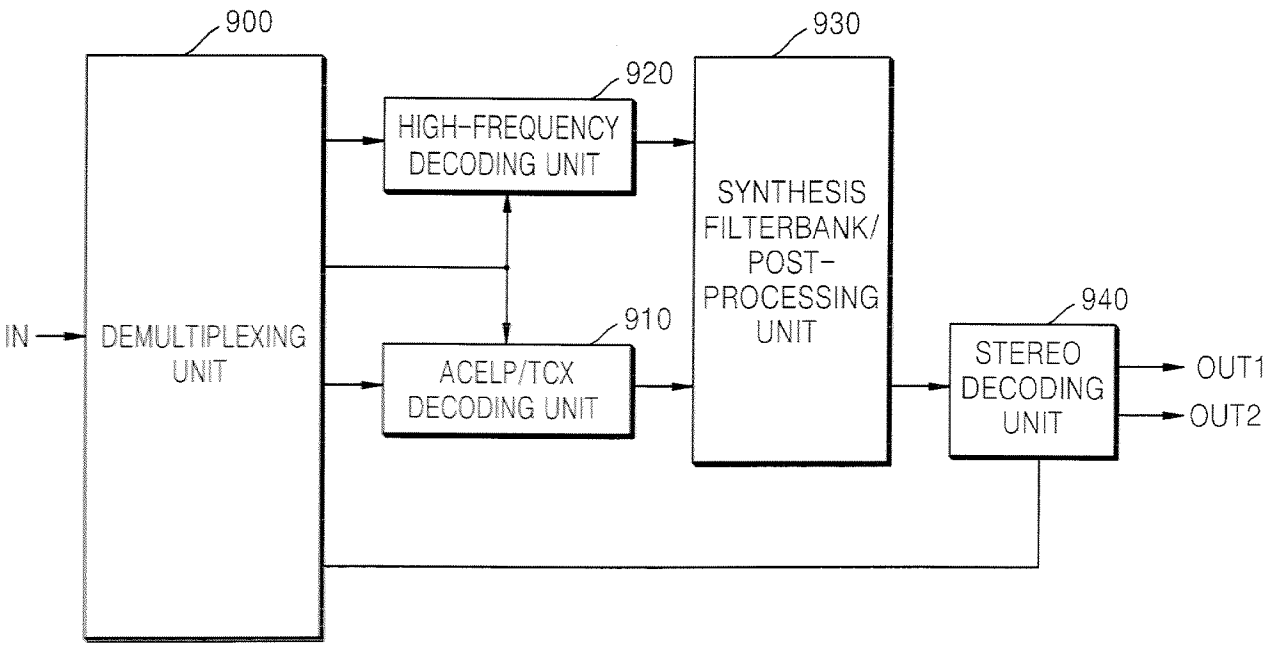
FIG. 9 is a block diagram illustrating a signal decoding apparatus according to an embodiment of the present general inventive concept.

FIG. 9 is a block diagram illustrating a signal decoding apparatus according to an embodiment of the present general inventive concept. Referring to FIG. 9, the decoding apparatus includes a demultiplexing unit 900, a ACELP/TCX decoding unit 910, a high-frequency decoding unit 920, a synthesis filterbank/post-processing unit 930, and a stereo decoding unit 940. The current embodiment supports the CBR method in which decoding is completely and constantly (or fixedly) performed at a constant bitrate. In the current embodiment, a stereo signal and a high-frequency signal are decoded at a multi-bitrate.

The demultiplexing unit 900 receives a bitstream via an input terminal IN, and demultiplexes it. In this case, the bitstream is demultiplexed into information regarding a bitrate or coding mode applied to encode a stereo signal and a low-frequency signal, a spatial parameter obtained by encoding the stereo signal, a low-frequency signal encoded through ACELP/TCX encoding, a high-frequency signal encoded using either the low-frequency signal or BWE. The bitstream may have the same syntax as the bitstream illustrated in FIG. 2.

The ACELP/TCX decoding unit 910 decodes the low-frequency signal encoded through ACELP encoding or TCX encoding. The ACELP/TCX decoding unit 910 decodes the low-frequency signal at a multi-bitrate. Thus, the low-frequency signal is decoded according to a bitrate or decoding mode corresponding to a bitrate or coding mode that was used to encode the low-frequency signal.

The high-frequency decoding unit 920 decodes the high-frequency signal by using the low-frequency signal decoded by the ACELP/TCX decoding unit 910 or by using BWE. More specifically, the high-frequency signal is decoded by generating a signal corresponding to a high-frequency band by using the decoded low-frequency signal, decoding a gain(s) or spectral envelope information, and applying the result of the decoding to the signal. In this case, the signal corresponding to the high-frequency may be generated by directly copying the low-frequency signal to the high-frequency band or by performing symmetry folding on the low-frequency signal with respect to a predetermined frequency.

The high-frequency decoding unit 920 can decode the high-frequency signal at a constant bitrate, unlike the ACELP/TCX decoding unit 910 and the stereo decoding unit 940.

The synthesis filterbank/post-processing unit 930 restores a mono signal by combining the low-frequency signal decoded by the ACELP/TCX decoding unit 910 with the high-frequency signal decoded by the high-frequency decoding unit 920.

The stereo decoding unit 940 upmixes the restored mono signal to two channel signals and then outputs the two channel signals via an output terminal OUT. For example, the two channel signals may be stereo signals including a left signal and a right signal. However, the present general inventive concept is not limited thereto, and the mono signal may be upmixed to multi-channel signals, i.e., three or more channel signals.

For example, the stereo decoding unit 940 may upmix the mono signal to two channel signals by decoding a spatial parameter representing the relationship between the two channel signals and the mono signal and using the result of decoding. The spatial parameter may represent the difference between the energy levels of channels, or the correlation or coherence between the channels. The stereo decoding unit 940 decodes a stereo signal at a multi-bitrate. Thus, the stereo signal is decoded according to a bitrate or decoding mode corresponding to a bitrate or coding mode that was applied to encode the stereo signal.

The stereo decoding unit 940 allows AMR-WB+ to efficiently decode a stereo signal or a multi-channel signal by applying the parametric stereo method or the parametric multi-channel method.

Figure 10:
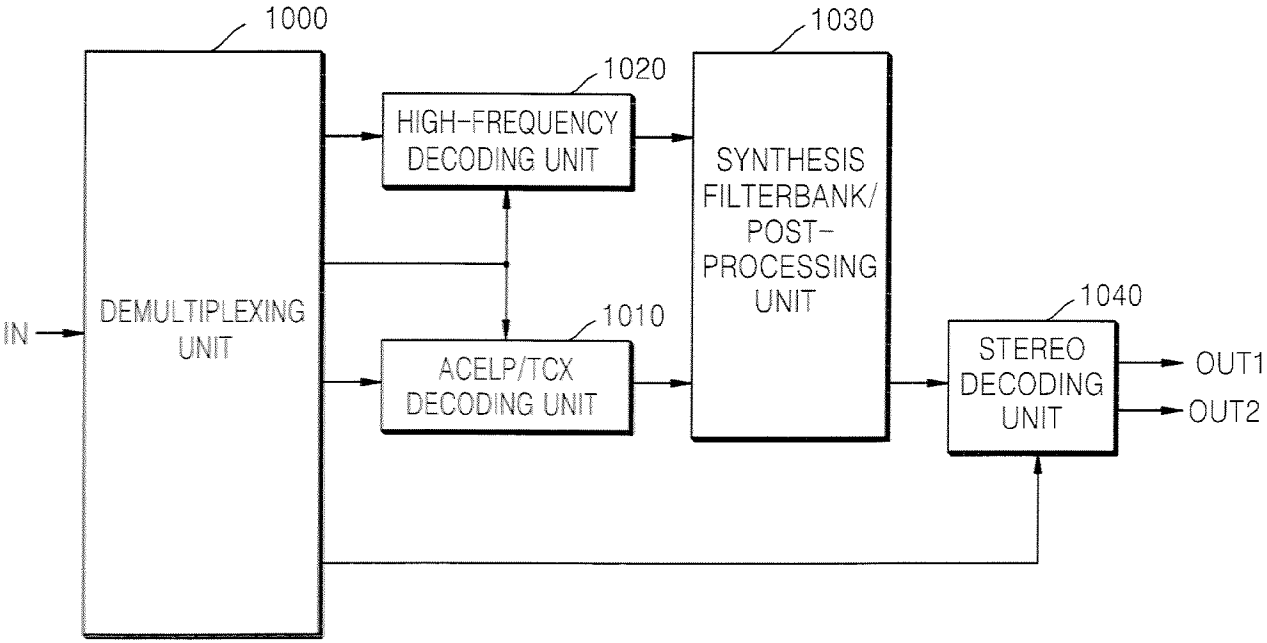
FIG. 10 is a block diagram illustrating a signal decoding apparatus according to another embodiment of the present general inventive concept.

FIG. 10 is a block diagram illustrating a signal decoding apparatus according to another embodiment of the present general inventive concept. Referring to FIG. 10, the decoding apparatus includes a demultiplexing unit 1000, an ACELP/TCX decoding unit 1010, a high-frequency decoding unit 1020, a synthesis filterbank/post-processing unit 1030 and a stereo decoding unit 1040. The current embodiment supports both the CBR method in which decoding is completely and constantly (or fixedly) performed at a constant bitrate, and the VBR method in which decoding is performed at a variable bitrate while adaptively determining a bitrate in various ways. In the current embodiment, a stereo signal and a high-frequency signal are decoded at a multi-bitrate.

The demultiplexing unit 1000 receives a bitstream via an input terminal IN, and demultiplexes it. In this case, the bitstream is demultiplexed into information regarding a bitrate or coding mode applied to encode a stereo signal and a low-frequency signal, a spatial parameter obtained by encoding the stereo signal, a low-frequency signal encoded through ACELP/TCX encoding, a high-frequency signal encoded using either the low-frequency signal or BWE. The bitstream may have the same syntax as the bitstream illustrated in FIG. 4.

ACELP/TCX decoding unit 1010 decodes the low-frequency signal encoded through ACELP encoding or TCX encoding. The ACELP/TCX decoding unit 910 decodes the low-frequency signal at a multi-bitrate. Thus, the low-frequency signal is decoded according to a bitrate or decoding mode corresponding to a bitrate or coding mode that was used to encode the low-frequency signal.

The high-frequency decoding unit 1020 decodes the high-frequency signal by using the low-frequency signal decoded by the ACELP/TCX decoding unit 1010 or by using BWE. More specifically, the high-frequency signal is decoded by generating a signal corresponding to a high-frequency band by using the decoded low-frequency signal, decoding a gain(s) or spectral envelope information, and applying the result of the decoding to the signal. In this case, the signal corresponding to the high-frequency may be generated by directly copying the low-frequency signal to the high-frequency band or by performing symmetry folding on the low-frequency signal with respect to a predetermined frequency.

The high-frequency decoding unit 1020 can decode the high-frequency signal at a constant bitrate, unlike the ACELP/TCX decoding unit 1010 and the stereo decoding unit 1040.

The synthesis filterbank/post-processing unit 1030 restores a mono signal by combining the low-frequency signal decoded by the ACELP/TCX decoding unit 1010 with the high-frequency signal decoded by the high-frequency decoding unit 1020.

The stereo decoding unit 1040 upmixes the restored mono signal to two channel signals and then outputs the two channel signals via an output terminal OUT. For example, the two channel signals may be stereo signals including a left signal and a right signal. However, the present general inventive concept is not limited thereto, and the mono signal may be upmixed to multi-channel signals, i.e., three or more channel signals.

For example, the stereo decoding unit 1040 may upmix the mono signal to two channel signals by decoding a spatial parameter representing the relationship between the two channel signals and the mono signal and using the result of decoding. The spatial parameter may represent the difference between the energy levels of channels, or the correlation or coherence between the channels. The stereo decoding unit 1040 decodes a stereo signal at a multi-bitrate. Thus, the stereo signal is decoded according to a bitrate or decoding mode corresponding to a bitrate or coding mode that was applied to encode the stereo signal.

The stereo decoding unit 1040 allows AMR-WB+ to efficiently decode a stereo signal or a multi-channel signal by applying the parametric stereo method or the parametric multi-channel method.

Figure 11:
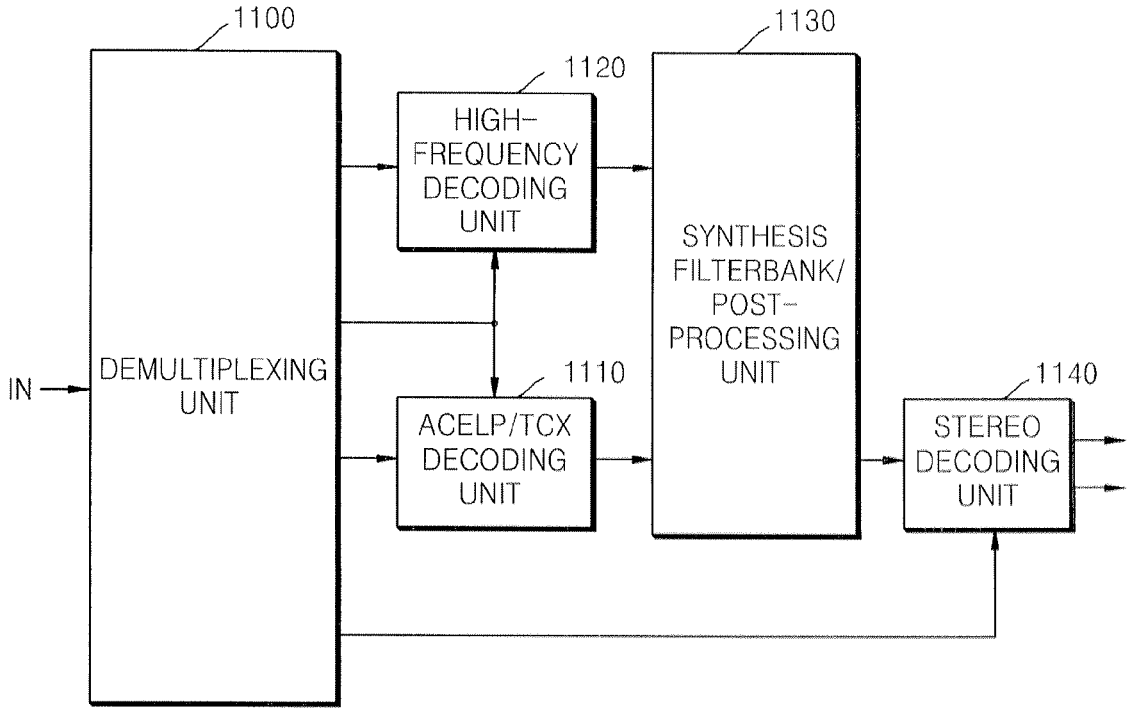
FIG. 11 is a block diagram illustrating a signal decoding apparatus according to another embodiment of the present general inventive concept.

FIG. 11 is a block diagram illustrating a signal decoding apparatus according to another embodiment of the present general inventive concept. Referring to FIG. 11, the decoding apparatus includes a demultiplexing unit 1100, an ACELP/TCX decoding unit 1110, a high-frequency decoding unit 1120, a synthesis filterbank/post-processing unit 1130 and a stereo decoding unit 1140. The current embodiment supports the VBR method in which decoding is performed at a variable bitrate while adaptively determining a bitrate in various ways. In the current embodiment, a stereo signal is decoded at a variable bitrate and a low-frequency signal is decoded at a multi-bitrate.

The demultiplexing unit 1100 receives a bitstream via an input terminal IN, and demultiplexes it. In this case, the bitstream is demultiplexed into a target bitrate, information regarding bits being used to encode a stereo signal in units of frames, information regarding a bitrate or coding mode applied to encode a low-frequency signal, a spatial parameter obtained by encoding the stereo signal, a low-frequency signal encoded through ACELP/TCX encoding, a high-frequency signal encoded using either the low-frequency signal or BWE.

The bitstream may have the same syntax as the bitstream illustrated in FIG. 6 or 7. In this case, the target bitrate is first received, and additionally, the information regarding bits being used to encode the stereo signal at a variable bitrate and the information regarding the bitrate or coding mode used to encode the low-frequency signal at a multi-bitrate are received in units of frames.

The ACELP/TCX decoding unit 1110 decodes the low-frequency signal encoded through ACELP encoding or TCX encoding. The ACELP/TCX decoding unit 1110 decodes the low-frequency signal at a multi-bitrate. Thus, the low-frequency signal is decoded according to a bitrate or decoding mode corresponding to a bitrate or coding mode that was used to encode the low-frequency signal.

The high-frequency decoding unit 1120 decodes the high-frequency signal by using the low-frequency signal decoded by the ACELP/TCX decoding unit 1110 or by using BWE. More specifically, the high-frequency signal is decoded by generating a signal corresponding to a high-frequency band by using the decoded low-frequency signal, decoding a gain(s) or spectral envelope information, and applying the result of the decoding to the signal. In this case, the signal corresponding to the high-frequency may be generated by directly copying the low-frequency signal to the high-frequency band or by performing symmetry folding on the low-frequency signal with respect to a predetermined frequency.

The high-frequency decoding unit 1120 can decode the high-frequency signal at a constant bitrate, unlike the ACELP/TCX decoding unit 1110 and the stereo decoding unit 1140.

The synthesis filterbank/post-processing unit 1130 restores a mono signal by combining the low-frequency signal decoded by the ACELP/TCX decoding unit 1110 with the high-frequency signal decoded by the high-frequency decoding unit 1120.

The stereo decoding unit 1140 upmixes the restored mono signal to two channel signals and then outputs the two channel signals via an output terminal OUT. For example, the two channel signals may be stereo signals including a left signal and a right signal. However, the present general inventive concept is not limited thereto, and the mono signal may be upmixed to multi-channel signals, i.e., three or more channel signals.

For example, the stereo decoding unit 1140 may upmix the mono signal to two channel signals by decoding a spatial parameter representing the relationship between the two channel signals and the mono signal and using the result of decoding. The spatial parameter may represent the difference between the energy levels of channels, or the correlation or coherence between the channels. The stereo decoding unit 1140 decodes a stereo signal at a multi-bitrate. Thus, the stereo signal is decoded according to a bitrate or decoding mode corresponding to a bitrate or coding mode that was applied to encode the stereo signal.

The stereo decoding unit 1140 allows AMR-WB+ to efficiently decode a stereo signal or a multi-channel signal by applying the parametric stereo method or the parametric multi-channel method.

Figure 12:
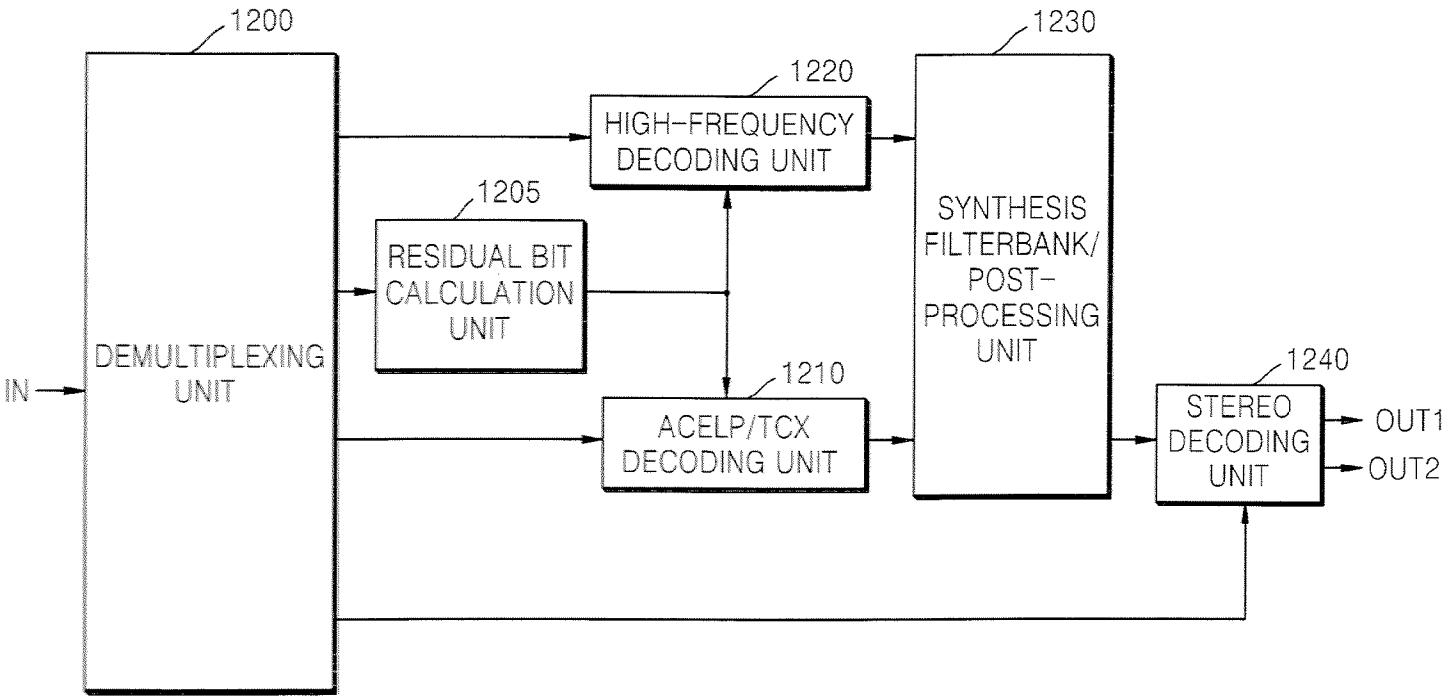
FIG. 12 is a block diagram illustrating a signal decoding apparatus according to another embodiment of the present general inventive concept.

FIG. 12 is a block diagram illustrating a signal decoding apparatus according to another embodiment of the present general inventive concept. Referring to FIG. 12, the decoding apparatus includes a demultiplexing unit 1200, a residual bit calculation unit 1205, an ACELP/TCX decoding unit 1210, a high-frequency decoding unit 1220, a synthesis filterbank/post-processing unit 1230 and a stereo decoding unit 1240. The current embodiment supports the VBR method in which decoding is performed at a variable bitrate while adaptively determining a bitrate in various ways. In the current embodiment, a stereo signal is decoded at a variable bitrate and a low-frequency signal is decoded at a multi-bitrate. However, the decoding apparatus illustrated in FIG. 12 decodes a bitstream, the syntax of which is different from that of the bitstream described above with reference to the decoding apparatus illustrated in FIG. 11.

The demultiplexing unit 1200 receives a bitstream from an encoding terminal (not illustrated) via an input terminal IN, and demultiplexes it. In this case, the bitstream is demultiplexed into a target bitrate, information regarding bits being used to encode a stereo signal in units of frames, a spatial parameter obtained by encoding the stereo signal, a low-frequency signal encoded through ACELP/TCX encoding, a high-frequency signal encoded using either the low-frequency signal or BWE.

The bitstream may have the same syntax as the bitstream illustrated in FIG. 8. In this case, the target bitrate is first received, and additionally, the information regarding bits being used to encode the stereo signal at a variable bitrate is received in units of frames. However, the bitstream that the demultiplexing unit 1200 received from the encoding terminal does not contain information regarding a bitrate or coding mode used to encode the low-frequency signal, unlike in FIG. 11.

The residual bit calculation unit 1205 calculates residual bits by subtracting the bits being used to encode the stereo signal at the variable bitrate from bits corresponding to the target bitrate. The residual bit calculation unit 1205 detects a bitrate or decoding mode closest to the result of subtracting from among bitrates or decoding modes that do not exceed the result of the subtracting. In this way, it is possible to detect a bitrate or decoding mode corresponding to the bitrate or coding mode used to encode the low-frequency signal without information regarding the bitrate or coding mode used to encode the low-frequency signal.

The residual bit calculation unit 1205 makes it possible to provide a signal for efficient decoding or to determine a bitrate or decoding mode when decoding a stereo signal or a multi-channel signal by applying the parametric stereo method or the parametric multi-channel method.

The ACELP/TCX decoding unit 1210 decodes the low-frequency signal encoded through ACELP encoding or TCX encoding. The ACELP/TCX decoding unit 1210 decodes the low-frequency signal at a multi-bitrate. Thus, the low-frequency signal is decoded according to the bitrate or decoding mode detected by the residual bit calculation unit 1205.

The high-frequency decoding unit 1220 decodes the high-frequency signal by using the low-frequency signal decoded by the ACELP/TCX decoding unit 1210 or by using BWE. More specifically, the high-frequency signal is decoded by generating a signal corresponding to a high-frequency band by using the decoded low-frequency signal, decoding a gain(s) or spectral envelope information, and applying the result of the decoding to the signal. In this case, the signal corresponding to the high-frequency may be generated by directly copying the low-frequency signal to the high-frequency band or by performing symmetry folding on the low-frequency signal with respect to a predetermined frequency.

The high-frequency decoding unit 1220 can decode the high-frequency signal at a constant bitrate.

The synthesis filterbank/post-processing unit 1230 restores a mono signal by combining the low-frequency signal decoded by the ACELP/TCX decoding unit 1210 with the high-frequency signal decoded by the high-frequency decoding unit 1220.

The stereo decoding unit 1240 upmixes the restored mono signal to two channel signals and then outputs the two channel signals via an output terminal OUT. For example, the two channel signals may be stereo signals including a left signal and a right signal. However, the present general inventive concept is not limited thereto, and the mono signal may be upmixed to multi-channel signals, i.e., three or more channel signals.

For example, the stereo decoding unit 1240 may upmix the mono signal to two channel signals by decoding a spatial parameter representing the relationship between the two channel signals and the mono signal and using the result of decoding. The spatial parameter may represent the difference between the energy levels of channels, or the correlation or coherence between the channels. The stereo decoding unit 1240 decodes a stereo signal at a variable bitrate. Thus, the stereo signal is decoded with the bits being used to encode the stereo signal in units of frames.

The stereo decoding unit 1240 allows AMR-WB+ to efficiently decode a stereo signal or a multi-channel signal by applying the parametric stereo method or the parametric multi-channel method.

Figure 13:
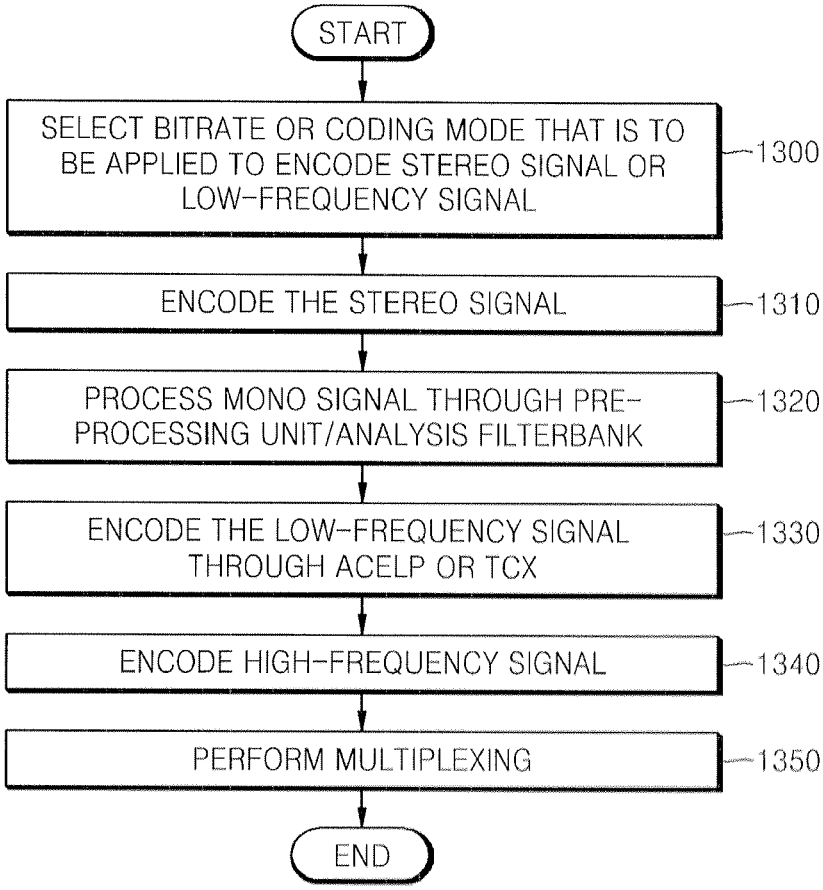
FIG. 13 is a flowchart illustrating a signal encoding method according to an embodiment of the present general inventive concept.

FIG. 13 is a flowchart illustrating a signal encoding method according to an embodiment of the present general inventive concept. The method of FIG. 13 supports the CBR method in which encoding is completely and constantly (or fixedly) performed at a constant bitrate. In the current embodiment, a stereo signal and a low-frequency signal are encoded at a multi-bitrate.

A plurality of bitrates or coding modes that are to be allocated in order to encode a stereo signal and a low-frequency signal are predetermined. A bitrate or coding mode are selected from among the predetermined bitrates or coding modes according to an input target bitrate, based on a predetermined criterion in operation 1300.

Input two channel signals are downmixed to a mono signal in operation 1310. For example, the two channel signals may be stereo signals including a left signal and a right signal. However, the present general inventive concept is not limited thereto and multi-channel signals, i.e., three or more channel signals, may be input.

Also, in operation 1310, a spatial parameter representing the relationship between the two channel signals and a mono signal is generated. The spatial parameter may represent the difference between the energy levels of channels or the correlation or coherence between the channels. In operation 1310, a stereo signal is encoded at a multi-bitrate, and thus, the spatial parameter is generated according to the bitrate or coding mode selected in operation 1300.

Operation 1310 allows AMR-WB+ to efficiently encode a stereo signal or a multi-channel signal by applying the parametric stereo method or the parametric multi-channel method.

In operation 1320, the mono signal is processed using a pre-processing unit/analysis filterbank. In operation 1320, the mono signal obtained in operation 1310 is divided into a low-frequency signal and a high-frequency signal. In operation 1320, the low-frequency signal may be generated by downsampling the mono signal through low-pass filtering, and the high-frequency signal may be generated by downsampling the mono signal through band-pass filtering.

In operation 1330, the low-frequency signal is encoded by selecting ACELP encoding or TCX encoding in units of frames, based on a predetermined criterion. The close-loop analysis-by-synthesis method may be used to select either one of ACELP encoding and TCX encoding. In operation 1330, the low-frequency signal is encoded at a multi-bitrate. Thus, the low-frequency signal is encoded according to the bitrate or coding mode selected in operation 1300.

Here, ACELP encoding may be performed in a similar manner to that performed by an AMR-WB speech codec, and includes long term prediction (LTP) analysis and synthesis, and algebraic codebook excitation. ACELP encoding may be performed using 256-sample frames.

TCX encoding may be performed using a perceptually weighted signal in the transform domain. In this case, algebraic vector quantization may be performed on the perceptually weighted signal through split multi-bitrate lattice quantization. Transformation may be performed using 1024, 512 or 256 sample windows. An excitation signal may be restored by inversely filtering the quantized perceptually weighted signal with the same inverse weighting filter as in AMR-WB.

The high-frequency signal obtained in operation 1320 is encoded in operation 1340. The high-frequency signal may be encoded either by using the low-frequency signal or by using BWE encoding a high-frequency signal at a low bitrate. In this case, in operation 1340, the high-frequency signal can be encoded using, at least in part, a gain(s) or spectral envelope information. Also, in operation 1340, the high-frequency signal can be encoded at a constant bitrate, unlike in operations 1310 and 1330.

The bitrate or coding mode selected in operation 1300, the spatial parameter encoded in operation 1310, the low-frequency signal encoded in operation 1330, and the high-frequency signal encoded in operation 1340 are multiplexed into a bitstream in operation 1350.

FIG. 2 is a conceptual diagram illustrating the syntax of the bitstream generated in operation 1350, according to an embodiment of the present general inventive concept. Referring to FIG. 2, the bitstream may include operation code 200, an internal sample frequency (ISF) index 210, and signal encoding data 220.

7 bits may be allocated to the operation code 200. The operation code 200 contains information regarding the bitrate or coding mode selected in operation 1300.

The ISF index 210 describes a predetermined internal sampling bitrate corresponding to each index. 5 bits are allocated to the ISF index 210 in order to represent an internal sampling frequency applied to each frame.

The signal encoding data 220 contains the spatial parameter encoded in operation 1310, data obtained by encoding the low-frequency signal in operation 1330, and a parameter obtained by encoding the high-frequency signal in operation 1340.

Figure 14:
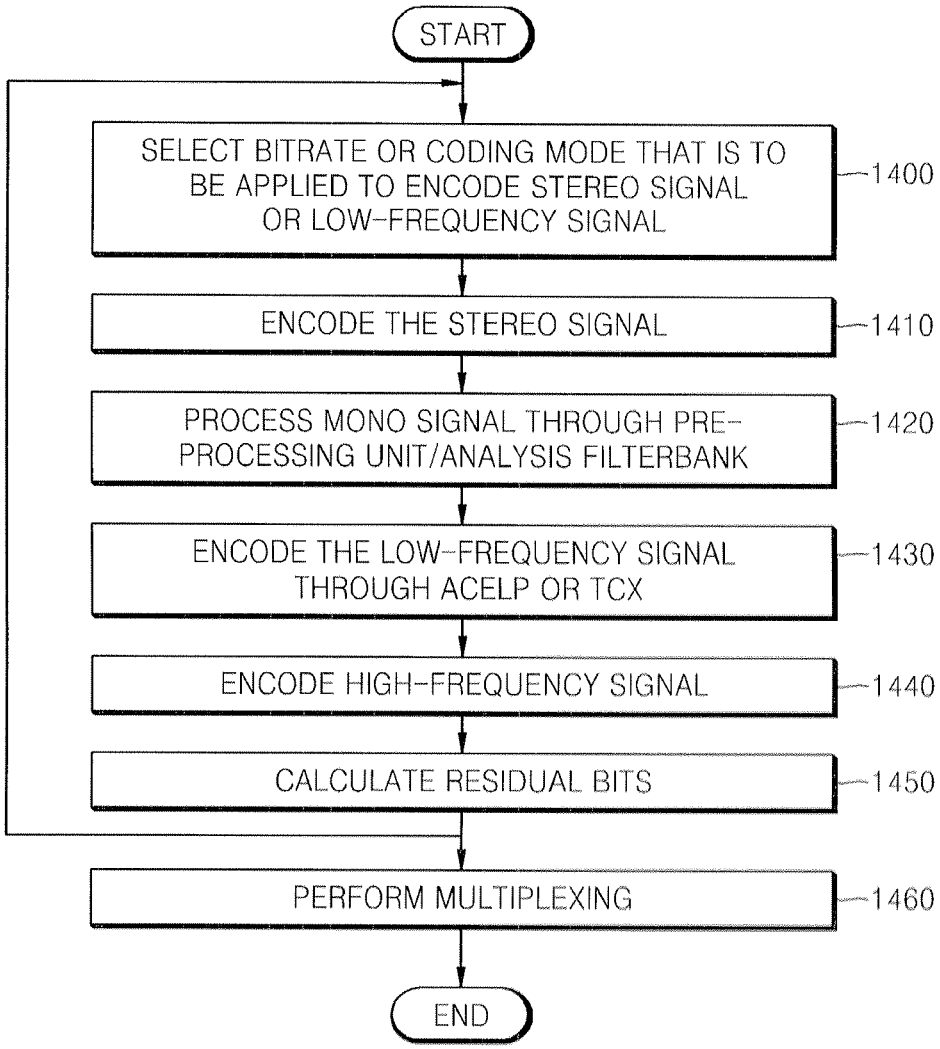
FIG. 14 is a flowchart illustrating a signal encoding method according to another embodiment of the present general inventive concept.

FIG. 14 is a flowchart illustrating a signal encoding method according to another embodiment of the present general inventive concept. The method of FIG. 14 supports both the CBR method in which encoding is completely and constantly (or fixedly) performed at a constant bitrate, and the VBR method in which encoding is performed at a variable bitrate while adaptively determining a bitrate in various ways. In the current embodiment, a stereo signal and a low-frequency signal are encoded at a multi-bitrate.

It is assumed that a plurality of bitrates or coding modes that are to be allocated in order to encode a stereo signal and a low-frequency signal are predetermined. A bitrate or coding mode are selected from among the predetermined bitrates or coding modes in units of frames, in consideration of an input target bitrate and residual bits that are to be calculated in operation 1450 and based on a predetermined criterion in operation 1400.

Input two channel signals are downmixed to a mono signal in operation 1410. For example, the two channel signals may be stereo signals including a left signal and a right signal. However, the present general inventive concept is not limited thereto and multi-channel signals, i.e., three or more channel signals, may be input.

Also, in operation 1410, a spatial parameter representing the relationship between the two channel signals and the mono signal is generated. The spatial parameter may represent the difference between the energy levels of channels or the correlation or coherence between the channels. In operation 1410, a stereo signal is encoded at a multi-bitrate, and thus, the spatial parameter is generated according to the bitrate or coding mode selected in operation 1400.

Operation 1410 allows AMR-WB+ to efficiently encode a stereo signal or a multi-channel signal by applying the parametric stereo method or the parametric multi-channel method.

In operation 1420, the mono signal obtained in operation 1410 is processed using a pre-processing unit/analysis filterbank. That is, in operation 1420, the mono signal is divided into a low-frequency signal and a high-frequency signal. In operation 1420, the low-frequency signal may be generated by downsampling the mono signal through low-pass filtering, and the high-frequency signal may be generated by downsampling the mono signal through band-pass filtering.

The low-frequency signal is encoded by selecting ACELP encoding or TCX encoding in units of frames, based on a predetermined criterion in operation 1430. The close-loop analysis-by-synthesis method may be used to select either one of ACELP encoding and TCX encoding. In operation 1330, the low-frequency signal is encoded at a multi-bitrate. Thus, the low-frequency signal is encoded according to the bitrate or coding mode selected in operation 1400.

Here, ACELP encoding may be performed in a similar manner to that performed by an AMR-WB speech codec, and includes long term prediction (LTP) analysis and synthesis, and algebraic codebook excitation. ACELP encoding may be performed using 256-sample frames.

TCX encoding may be performed using a perceptually weighted signal in the transform domain. In this case, algebraic vector quantization may be performed on the perceptually weighted signal through split multi-bitrate lattice quantization. Transformation may be performed using 1024, 512 or 256 sample windows. An excitation signal may be restored by inversely filtering the quantized perceptually weighted signal with the same inverse weighting filter as in AMR-WB.

In operation 1440, the high-frequency signal obtained in operation 1420 is encoded. In operation 1440, the high-frequency signal may be encoded either by using the low-frequency signal or by using BWE encoding a high-frequency signal at a low bitrate. In this case, in operation 1440, the high-frequency signal can be encoded using, at least in part, a gain(s) or spectral envelope information. Also, in operation 1440, the high-frequency signal can be encoded at a constant bitrate, unlike the stereo signal and the low-frequency signal.

Remaining residual bits, excluding bits used to encode the spatial parameter in operation 1410, to encode the low-frequency signal in operation 1430, and to encode the high-frequency signal in operation 1440, are calculated in operation 1450.

Thereafter, the bitrate or coding mode selected in operation 1400, the spatial parameter encoded in operation 1410, the result of encoding the low-frequency signal in operation 1430, and the result of encoding the high-frequency signal in operation 1440 are multiplexed into a bitstream, and then, the bitstream is output in operation 1460.

FIG. 4 is a conceptual diagram illustrating the syntax of the bitstream generated in operation 1460, according to an embodiment of the present general inventive concept. Referring to FIG. 4, the bitstream may include operation code 400, an ISF index 410, and signal encoding data 420.

7 bits may be allocated to the operation code 400. The operation code 400 contains information regarding the bitrate or coding mode selected in operation 1400.

The ISF index 410 describes a predetermined internal sampling bitrate corresponding to each index. 5 bits are allocated to the ISF index 410 in order to represent an internal sampling frequency applied to each frame.

The signal encoding data 420 contains the spatial parameter encoded in operation 1410, data obtained by encoding the low-frequency signal in operation 1430, and a parameter obtained by encoding the high-frequency signal in operation 1440.

Figure 15:
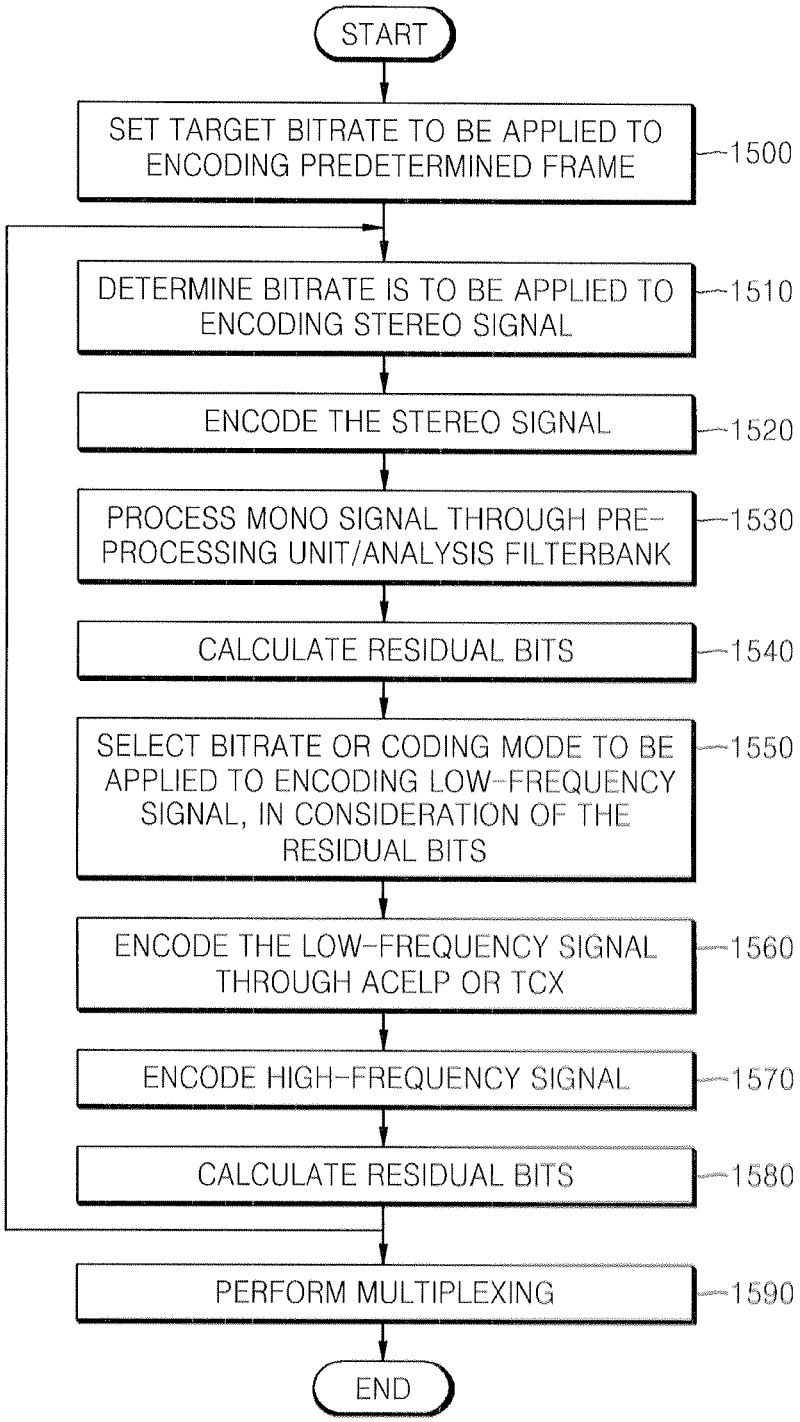
FIG. 15 is a flowchart illustrating a signal encoding method according to another embodiment of the present general inventive concept.

FIG. 15 is a flowchart illustrating a signal encoding method according to another embodiment of the present general inventive concept. The method of FIG. 15 supports the VBR method in which encoding is performed at a variable bitrate while adaptively determining a bitrate in various ways. In the current embodiment, a stereo signal is encoded at a variable bitrate and a low-frequency signal is encoded at a multi-bitrate.

A target bitrate that is to be allocated in order to encode a predetermined frame is set in operation 1500.

A target bitrate that is to be allocated to encode a stereo signal is determined in consideration of the target bitrate set in operation 1500 and residual bits that are to be calculated in operation 1580, and a stereo coding mode is selected from among a plurality of stereo coding modes set to correspond to a plurality of maximum stereo coding bitrates, based on the determined target bitrate and according to a predetermined criterion in operation 1510.

In operation 1520, input two channel signals are down-mixed to a mono signal. For example, the two channel signals may be stereo signals including a left signal and a right signal. However, the present general inventive concept is not limited thereto and multi-channel signals, i.e., three or more channel signals, may be input.

Also, in operation 1520, a spatial parameter representing the relationship between the two channel signals and the mono signal is generated. The spatial parameter may represent the difference between the energy levels of channels or the correlation or coherence between the channels.

Operation 1520 allows AMR-WB+ to efficiently encode a stereo signal or a multi-channel signal by applying the parametric stereo method or the parametric multi-channel method.

In operation 1520, the stereo signal is encoded at a variable bitrate, and the spatial parameter is generated in units of frames, according to the stereo coding mode selected in operation 1510.

In operation 1530, the mono signal obtained in operation 1520 is processed using a pre-processing unit/analysis filter-bank. That is, in operation 1530, the mono signal is divided into a low-frequency signal and a high-frequency signal. In operation 1530, the low-frequency signal may be generated by downsampling the mono signal through low-pass filtering, and the high-frequency signal may be generated by down-sampling the mono signal through band-pass filtering.

In operation 1540, the remaining residual bits from bits corresponding to the target bitrate, which was set in operation 1500, after encoding the stereo signal in operation 1520 are calculated.

It is assumed that a plurality of bitrates or coding modes that are to be allocated to encoding which will later be performed in operation 1560 are predetermined. In operation 1550, a bitrate or coding mode is selected in units of frames from among the predetermined bitrates or coding modes, in consideration of the residual bits calculated in operation 1540 and based on a predetermined criterion. For example, in operation 1550, a bitrate or coding mode closest to the calculated residual bits is detected from among a plurality of bitrates or coding modes that do not exceed the calculated residual bits.

Operations 1510, 1540 and 1550 make it possible to provide a signal for efficient encoding or to determine a bitrate or coding mode when encoding a stereo signal or a multi-channel signal by applying the parametric stereo method or the parametric multi-channel method.

The low-frequency signal generated in operation 1530 is encoded by selecting ACELP encoding or TCX encoding in units of frames, based on a predetermined criterion in operation 1560. The close-loop analysis-by-synthesis method may be used to select either one of ACELP encoding and TCX encoding.

In operation 1560, the low-frequency signal is encoded at a multi-bitrate. Thus, the low-frequency signal is encoded according to the bitrate or coding mode selected in operation 1550.

Here, ACELP encoding may be performed in a similar manner to that performed by the AMR-WB speech codec, and includes long term prediction (LTP) analysis and synthesis, and algebraic codebook excitation. ACELP encoding may be performed using 256-sample frames.

TCX encoding may be performed using a perceptually weighted signal in the transform domain. In this case, algebraic vector quantization may be performed on the perceptually weighted signal through split multi-bitrate lattice quantization. Transformation may be performed using 1024, 512 or 256 sample windows. An excitation signal may be restored by inversely filtering the quantized perceptually weighted signal with the same inverse weighting filter as in AMR-WB.

In operation 1570, the high-frequency signal obtained in operation 1530 is encoded. In operation 1570, the high-frequency signal may be encoded either by using the low-frequency signal or by using BWE encoding a high-frequency signal at a low bitrate. In this case, in operation 1570, the high-frequency signal can be encoded using, at least in part, a gain(s) or spectral envelope information. Also, in operation 1570, the high-frequency signal can be encoded at a constant bitrate.

In operation 1580, the remaining residual bits, excluding bits used to encode the low-frequency signal in operation 1530 and to encode the high-frequency signal in operation 1570, from among the residual bits calculated in operation 1540, are calculated.

In operation 1590, the target bitrate set in operation 1500, the bitrate or coding mode selected in operation 1510, the spatial parameter encoded in operation 1520, the bitrate or coding mode selected in operation 1550, the result of encoding the low-frequency signal in operation 1560, and the result of encoding the high-frequency signal in operation 1570 are multiplexed into a bitstream, and then, the bitstream is output.

Various embodiments of the syntax of the bitstream generated in operation 1590 according to the present general inventive concept are illustrated in the conceptual diagrams of FIGS. 6 through 8.

Referring to FIG. 6, the bitstream according to an embodiment of the present general inventive concept includes operation code 600, an ISF index 610, and signal encoding data 620. Referring to FIG. 6, information regarding bits being used at a variable bitrate and information regarding a coding mode used at a multi-bitrate are transmitted by including them in a header of the bitstream. The bits used at the variable bitrate include bits used to encode a stereo signal. The information regarding the coding mode used at the multi-bitrate includes information regarding a coding mode applied to encode a low-frequency signal in operation 1560.

The operation code 600 includes stereo information 602 regarding a bitrate or coding mode selected in operation 1510, and encoding information 604 regarding a bitrate or coding mode selected in operation 1550.

The ISF index 610 described a predetermined internal sampling bitrate corresponding to each index. 5 bits are allocated to the ISF index 610 in order to represent an internal sampling frequency applied to a related frame.

The signal encoding data 620 contains a spatial parameter encoded in operation 1520, data obtained by encoding a low-frequency signal in operation 560, and a parameter obtained by encoding a high-frequency signal in operation 570.

The operation code 600, the ISF index 610 and the signal encoding data 620 are data transmitted in units of frames.

Referring to FIG. 7, the bitstream according to another embodiment of the present general inventive concept includes a target bitrate 700, operation code 710, ISF index 720, and signal encoding data 730. Referring to FIG. 7, a target bitrate is first transmitted, and then, information regarding bits being used at a variable bitrate and information regarding a coding mode used at a multi-bitrate are additionally transmitted by including them in a header of the bitstream in units of frames. The information regarding the bits used at the variable bitrate includes information regarding bits used to encode a stereo signal. The information regarding the coding mode used at the multi-bitrate includes information regarding a coding mode applied to encode a low-frequency signal in operation 1560. The current embodiment may be applied when a bitrate or coding mode that is to be applied to encode a low-frequency signal is determined regardless of a bitrate or coding mode that is to be applied to encode a stereo signal.

The target bitrate 700 contains information on a target bitrate set in units of frames in operation 1500. The target bitrate 700 may be transmitted in units of frames but may be transmitted when, at least in part, there is a need to change the target bitrate 700.

The operation code 710 stereo information 712 regarding a bitrate or coding mode selected in operation 1510, and encoding information 714 regarding a bitrate or coding mode selected in operation 1550.

The ISF index 720 describes a predetermined internal sampling bitrate corresponding to each index. 5 bits are allocated to the ISF index 720 in order to represent an internal sampling frequency applied to a related frame.

The signal encoding data 730 contains a spatial parameter encoded in operation 1520, data obtained by encoding a low-frequency signal in operation 1560, and a parameter obtained by encoding a high-frequency signal in operation 1570.

The operation code 710, the ISF index 720, and the signal encoding data 730 are data transmitted in units of frames.

Referring to FIG. 8, the bitstream according to another embodiment of the present general inventive concept includes a target bitrate 800, operation code 810, an ISF index 820, and a signal encoding data 830. Referring to FIG. 8, the target bitrate 800 is first transmitted, and then, information regarding bits being used at a variable bitrate is additionally transmitted by being included in a header of the bitstream in units of frames. The information regarding the bits used at the variable bitrate includes information regarding bits used to encode a stereo signal. A coding mode used at a multi-bitrate is determined not to exceed the result of subtracting the variable bitrate from the target bitrate 800 and to be closest to the result of the subtracting. The current embodiment may be applied when encoding the other signals with residual bits remaining after subtracting bits used to encode a stereo signal from bits corresponding to target bitrate 800.

The target bitrate 800 contains information on a target bitrate set in units of frames in operation 1500. The target bitrate 800 may be transmitted in units of frames but may be transmitted when, at least in part, there is a need to change the target bitrate 800.

The operation code 810 includes stereo information 812 regarding a bitrate or coding mode selected in operation 1510.

The ISF index 820 describes an internal sampling bitrate corresponding to each frame. 5 bits are allocated to the ISF index 820 in order to represent an internal sampling frequency applied to a related frame.

The signal encoding data 830 includes a spatial parameter encoded in operation 1520, data obtained by encoding a low-frequency signal in operation 1560, and a parameter obtained by encoding a high-frequency signal in operation 1570.

The operation code 810, the ISF index 820 and the signal encoding data 830 are data transmitted in units of frames.

Figure 16:
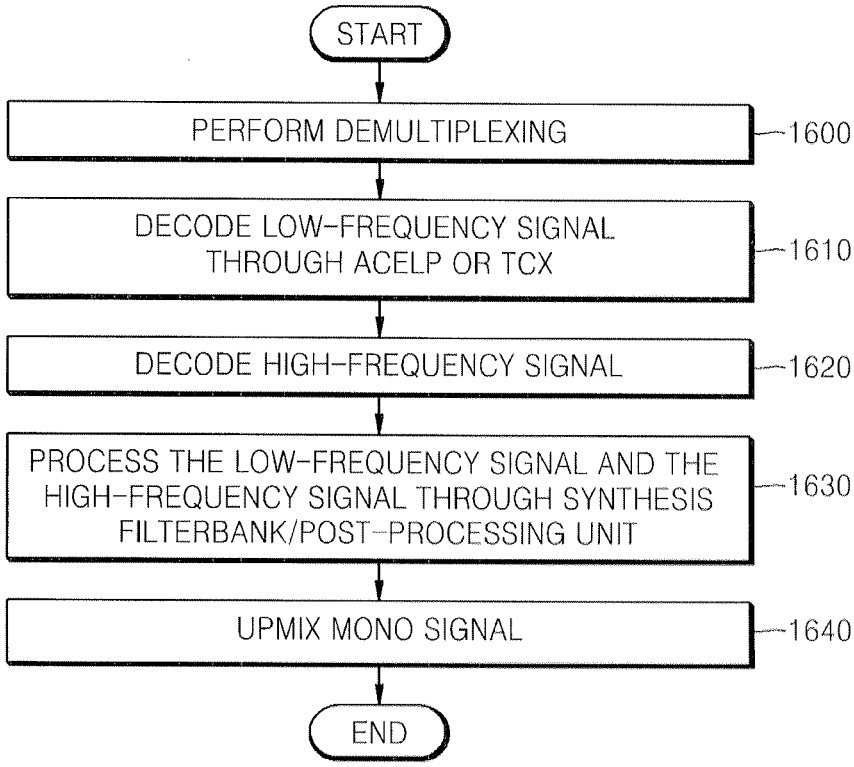
FIG. 16 is a flowchart illustrating a signal decoding method according to an embodiment of the present general inventive concept.

FIG. 16 is a flowchart illustrating a signal decoding method according to an embodiment of the present general inventive concept. The method of FIG. 16 supports the CBR method in which encoding is completely and constantly (or fixedly) performed at a constant bitrate. In the current embodiment, a stereo signal and a high-frequency signal are decoded at a multi-bitrate.

In operation 1600, a bitstream is received from an encoding terminal and is then demultiplexed. In operation 1600, the bitstream is demultiplexed into information regarding a bitrate or coding mode according to which a stereo signal and a low-frequency signal were encoded, a spatial parameter obtained by encoding the stereo signal, the low-frequency signal encoded through ACELP/TCX encoding, and a high-frequency signal encoded using either the low-frequency signal or through BWE. The syntax of the bitstream may be as illustrated in FIG. 2.

In operation 1610, the low-frequency signal encoded through ACELP encoding or TCX encoding is decoded. In operation 1610, since the low-frequency signal is decoded at the multi-bitrate, the low-frequency signal is decoded according to a bitrate or decoding mode corresponding to the bitrate or coding mode according to which the low-frequency signal was encoded.

In operation 1620, the high-frequency signal is decoded either by using the low-frequency signal decoded in operation 1610 or by using BWE. More specifically, the high-frequency signal is decoded by generating a signal at a high-frequency band by using the low-frequency signal decoded in operation 1610, decoding a gain(s) or spectral envelope information, and then applying the result of the decoding to the generated signal. In order to generate the signal at the high-frequency band by using the low-frequency signal, it is possible to directly copy the low-frequency signal to the high-frequency band or perform symmetry folding on the low-frequency signal with respect to a predetermined frequency.

In operation 1620, the high-frequency signal can be decoded at a constant bitrate, unlike a low-frequency signal and a stereo signal.

In operation 1630, the low-frequency signal decoded in operation 1610 and the high-frequency signal decoded in operation 1620 are processed through a synthesis filter bank/post-processing unit. In other words, in operation 1630, a mono signal is restored by combining the low-frequency signal decoded in operation 1610 and the high-frequency signal decoded in operation 1620.

In operation 1640, the mono signal restored in operation 1630 is upmixed to two channel signals. For example, the two channel signals may be stereo signals including a left signal and a right signal. However, the present general inventive concept is not limited thereto, and the mono signal may be upmixed to multi-channel signals including three or more channel signals.

For example, in operation 1640, the mono signal may be upmixed to two channel signals by decoding a spatial parameter representing the relationship between the two channel signals and the mono signal and using the decoded spatial parameter. The spatial parameter may represent the difference between the energy levels of channels, or the correlation or coherence between the channels. In operation 1640, since a stereo signal is decoded at a multi-bitrate, the stereo signal is decoded according to a bitrate or decoding mode corresponding to the bitrate or coding mode according to which the stereo signal was encoded.

Operation 1640 allows AMR-WB+ to efficiently decode a stereo signal or a multi-channel signal by applying the parametric stereo method or the parametric multi-channel method.

Figure 17:
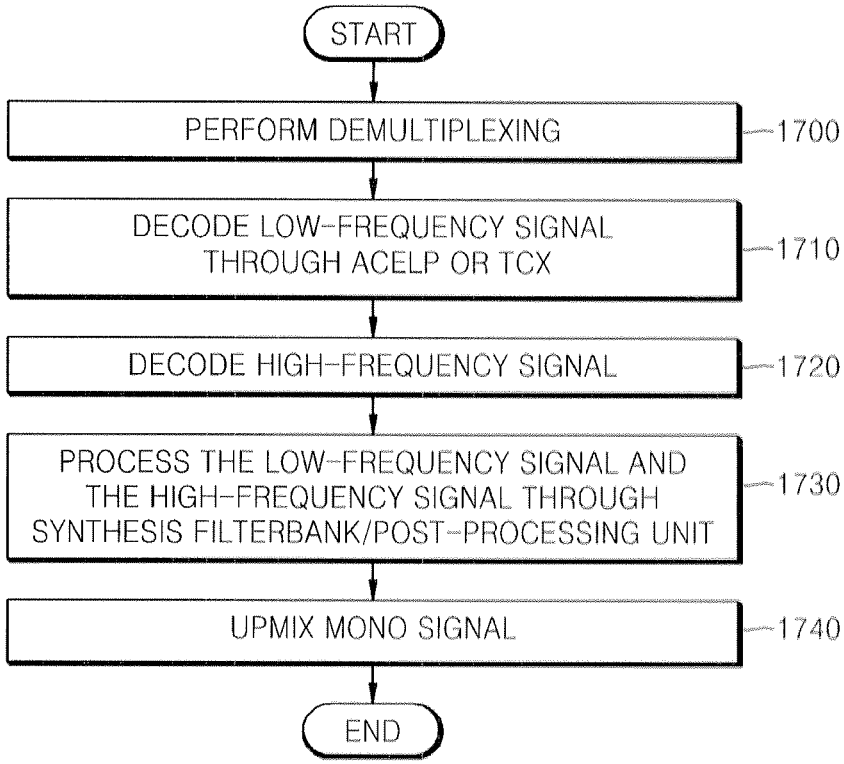
FIG. 17 is a flowchart illustrating a signal decoding method according to another embodiment of the present general inventive concept.

FIG. 17 is a flowchart illustrating a signal decoding method according to another embodiment of the present general inventive concept. The method of FIG. 17 supports both the CBR method in which encoding is completely and constantly (or fixedly) performed at a constant bitrate, and the VBR method in which encoding is performed at a variable bitrate while adaptively determining a bitrate in various ways. In the current embodiment, a stereo signal and a low-frequency signal are decoded at a multi-bitrate.

In operation 1700, a bitstream is received from an encoding terminal and is then demultiplexed. In operation 1700, the bitstream is demultiplexed into information regarding a bitrate or coding mode according to which a stereo signal and a low-frequency signal were encoded at a multi-bitrate in units of frames, a spatial parameter obtained by encoding the stereo signal, the low-frequency signal encoded through ACELP/TCX encoding, and a high-frequency signal encoded using either the low-frequency signal or through BWE. The syntax of the bitstream may be as illustrated in FIG. 4.

In operation 1710, the low-frequency signal encoded through ACELP encoding or TCX encoding is decoded. In operation 1710, since the low-frequency signal is decoded at the multi-bitrate, the low-frequency signal is decoded according to a bitrate or decoding mode corresponding to the bitrate or coding mode according to which the low-frequency signal was encoded in units of frames.

In operation 1720, the high-frequency signal is decoded either by using the low-frequency signal decoded in operation 1710 or by using BWE. More specifically, the high-frequency signal is decoded by generating a signal at a high-frequency band by using the low-frequency signal decoded in operation 1710, decoding a gain(s) or spectral envelope information, and then applying the result of the decoding to the generated signal. In order to generate the signal at the high-frequency band by using the low-frequency signal, it is possible to directly copy the low-frequency signal to the high-frequency band or perform symmetry folding on the low-frequency signal with respect to a predetermined frequency.

In operation 1720, the high-frequency signal can be decoded at a constant bitrate, unlike a low-frequency signal and a stereo signal.

In operation 1730, the low-frequency signal decoded in operation 1710 and the high-frequency signal decoded in operation 1720 are processed through a synthesis filter bank/post-processing unit. In other words, in operation 1730, a mono signal is restored by combining the low-frequency signal decoded in operation 1710 and the high-frequency signal decoded in operation 1720.

The mono signal restored in operation 1730 is upmixed to two channel signals in operation 1740. For example, the two channel signals may be stereo signals including a left signal and a right signal. However, the present general inventive concept is not limited thereto, and the mono signal may be upmixed to multi-channel signals including three or more channel signals.

For example, in operation 1740, the mono signal may be upmixed to two channel signals by decoding a spatial parameter representing the relationship between the two channel signals and the mono signal and using the decoded spatial parameter. The spatial parameter may represent the difference between the energy levels of channels, or the correlation or coherence between the channels. In operation 1740, since a stereo signal is decoded at a multi-bitrate, the stereo signal is decoded according to a bitrate or decoding mode corresponding to the bitrate or coding mode according to which the stereo signal was encoded.

Operation 1740 allows AMR-WB+ to efficiently decode a stereo signal or a multi-channel signal by applying the parametric stereo method or the parametric multi-channel method.

Figure 18:
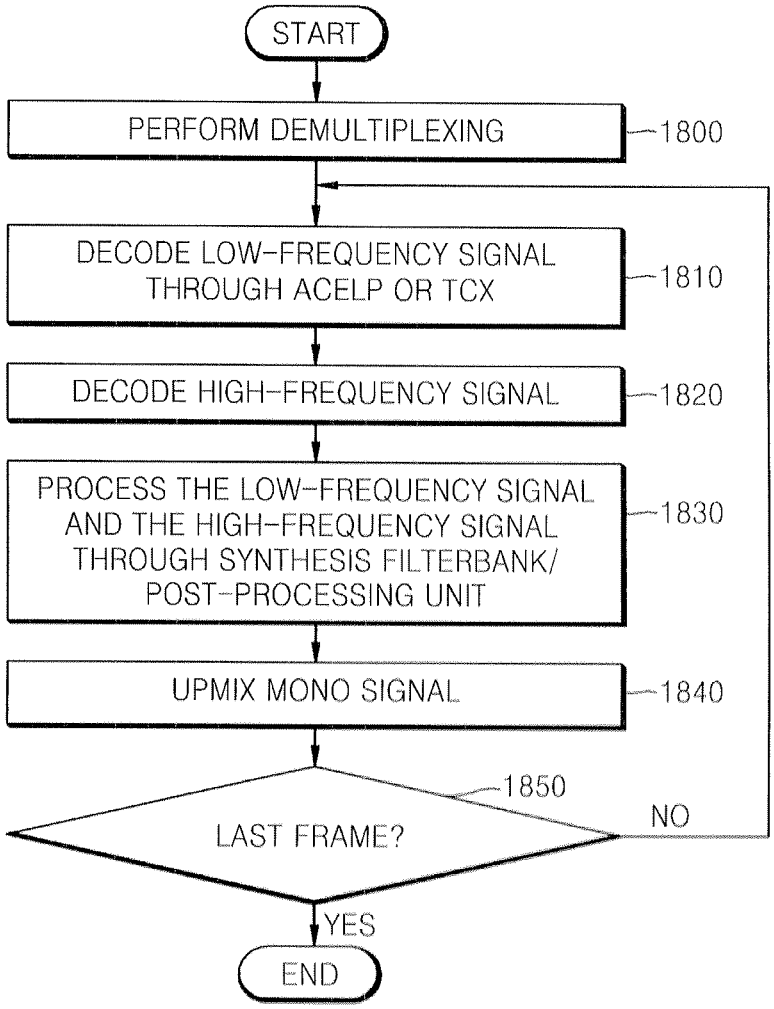
FIG. 18 is a flowchart illustrating a signal decoding method according to another embodiment of the present general inventive concept.

FIG. 18 is a flowchart illustrating a signal decoding method according to another embodiment of the present general inventive concept. The method of FIG. 18 supports the VBR method in which encoding is performed at a variable bitrate while adaptively determining a bitrate in various ways. In the current embodiment, a stereo signal is decoded at a variable bitrate and a low-frequency signal is decoded at a multi-bitrate.

In operation 1800, a bitstream is received from an encoding terminal and is then demultiplexed. In operation 1800, the bitstream is demultiplexed into a target bitrate, information regarding bits being used to encode a stereo signal in units of frames, a spatial parameter obtained by encoding the stereo signal, a low-frequency signal encoded through ACELP/TCX encoding, and a high-frequency signal encoded using either the low-frequency signal or through BWE.

The syntax of the bitstream may be as illustrated in FIG. 6 or 7. The target bitrate is first received, and additionally, the information regarding bits being used to encode the stereo signal at the variable bitrate and information regarding a bitrate or coding mode used to encode the low-frequency signal at a multi-rate are received in units of frames.

In operation 1810, the low-frequency signal encoded through ACELP encoding or TCX encoding is decoded. In operation 1810, since the low-frequency signal is decoded at the multi-bitrate, the low-frequency signal is decoded according to a bitrate or decoding mode corresponding to the bitrate or coding mode according to which the low-frequency signal was encoded in units of frames.

In operation 1820, the high-frequency signal is decoded either by using the low-frequency signal decoded in operation 1810 or by using BWE. More specifically, the high-frequency signal is decoded by generating a signal at a high-frequency band by using the low-frequency signal decoded in operation 1810, decoding a gain(s) or spectral envelope information, and then applying the result of the decoding to the generated signal. In order to generate the signal at the high-frequency band by using the low-frequency signal, it is possible to directly copy the low-frequency signal to the high-frequency band or perform symmetry folding on the low-frequency signal with respect to a predetermined frequency.

In operation 1820, the high-frequency signal can be decoded at a constant bitrate, unlike a low-frequency signal and a stereo signal.

In operation 1830, the low-frequency signal decoded in operation 1810 and the high-frequency signal decoded in operation 1820 are processed through a synthesis filter bank/post-processing unit. In other words, in operation 1830, a mono signal is restored by combining the low-frequency signal decoded in operation 1810 and the high-frequency signal decoded in operation 1820.

In operation 1840, the mono signal restored in operation 1830 is upmixed to two channel signals. For example, the two channel signals may be stereo signals including a left signal and a right signal. However, the present general inventive concept is not limited thereto, and the mono signal may be upmixed to multi-channel signals including three or more channel signals.

For example, in operation 1840, the mono signal may be upmixed to two channel signals by decoding a spatial parameter representing the relationship between the two channel signals and the mono signal and using the decoded spatial parameter. The spatial parameter may represent the difference between the energy levels of channels or the correlation or coherence between the channels. In operation 1840, since a stereo signal is decoded at a variable bitrate, the stereo signal is decoded using bits corresponding to the bits being used to encode the stereo signal in units of frames.

Operation 1840 allows AMR-WB+ to efficiently decode a stereo signal or a multi-channel signal by applying the parametric stereo method or the parametric multi-channel method.

In operation 1850, it is determined whether a frame decoded in operations 1810 through 1840 is a last frame. If it is determined in operation 1850 that the decoded frame is not the last frame, operations 1810 through 1840 are performed on a subsequent frame.

Figure 19:
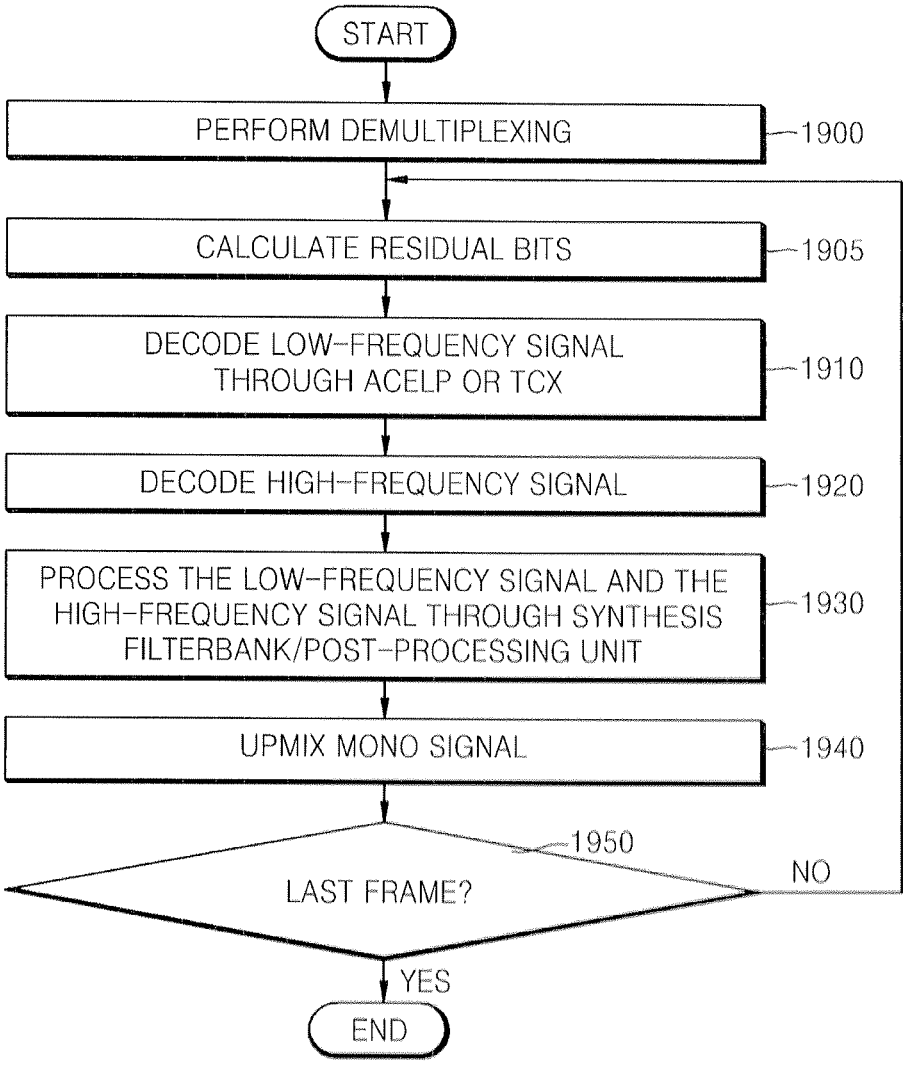
FIG. 19 is a flowchart illustrating a signal decoding method according to another embodiment of the present general inventive concept.

FIG. 19 is a flowchart illustrating a signal decoding method according to another embodiment of the present general inventive concept. The method of FIG. 19 supports the VBR method in which encoding is performed at a variable bitrate while adaptively determining a bitrate in various ways. In the current embodiment, a stereo signal is decoded at a variable bitrate and a low-frequency signal is decoded at a multi-bitrate. However, the method of FIG. 19 decodes a bitstream having different syntax compared to that of the bitstream described above with reference to FIG. 18.

In operation 1900, a bitstream is received from an encoding terminal and is then demultiplexed. In operation 1900, the bitstream is demultiplexed into a target bitrate, information regarding bits being to encode a stereo signal in units of frames, a spatial parameter obtained by encoding the stereo signal, a low-frequency signal encoded through ACELP/TCX encoding, and a high-frequency signal encoded using either the low-frequency signal or through BWE.

The syntax of the bitstream may be as illustrated in FIG. 8. The target bitrate is first received, and additionally, the information regarding bits being used to encode the stereo signal at the variable bitrate is received in units of frames. However, the bitstream received from the encoding terminal in FIG. 19 does not contain information regarding a bitrate or coding mode according to which the low-frequency signal was encoded, unlike in the method of FIG. 18.

In operation 1905, residual bits are calculated by subtracting the bits being used to encode the stereo signal at the variable bitrate from bits corresponding to target bitrate. Also, in operation 1905, a bitrate or decoding mode closest to the result of the subtracting is detected from among a plurality of bitrates or decoding modes that do not exceed the result of the subtracting. In this way, it is possible to detect a bitrate or decoding mode corresponding to the bitrate or coding mode according to which the low-frequency signal was encoded without information regarding the bitrate or coding mode according to which the low-frequency signal was encoded.

Operation 1905 makes it possible to provide a signal for efficient decoding or to determine a bitrate or decoding mode when decoding a stereo signal or a multi-channel signal by applying the parametric stereo method or the parametric multi-channel method.

In operation 1910, the low-frequency signal encoded through ACELP encoding or TCX encoding is decoded. In operation 1910, since the low-frequency signal is decoded at the multi-bitrate, the low-frequency signal is decoded according to the bitrate or decoding mode detected in operation 1905.

In operation 1920, the high-frequency signal is decoded either using the low-frequency signal decoded in operation 1910 or by using BWE. More specifically, the high-frequency signal is decoded by generating a signal at a high-frequency band by using the low-frequency signal decoded in operation 1910, decoding a gain(s) or spectral envelope information, and then applying the result of the decoding to the generated signal. In order to generate the signal at the high-frequency band by using the low-frequency signal, it is possible to directly copy the low-frequency signal to the high-frequency band or perform symmetry folding on the low-frequency signal with respect to a predetermined frequency.

In operation 1920, the high-frequency signal can be decoded at a constant bitrate.

In operation 1930, the low-frequency signal decoded in operation 1910 and the high-frequency signal decoded in operation 1920 are processed through a synthesis filter bank/post-processing unit. In other words, in operation 1930, a mono signal is restored by combining the low-frequency signal decoded in operation 1910 and the high-frequency signal decoded in operation 1920.

The mono signal restored in operation 1930 is upmixed to two channel signals in operation 1940. For example, the two channel signals may be stereo signals including a left signal and a right signal. However, the present general inventive concept is not limited thereto, and the mono signal may be upmixed to multi-channel signals including three or more channel signals.

For example, in operation 1940, the mono signal may be upmixed to two channel signals by decoding a spatial parameter representing the relationship between the two channel signals and the mono signal and using the decoded spatial parameter. The spatial parameter may represent the difference between the energy levels of channels or the correlation or coherence between the channels. In operation 1940, since a stereo signal is decoded at a variable bitrate, the stereo signal is decoded using bits corresponding to the bits being used to encode the stereo signal in units of frames.

Operation 1940 allows AMR-WB+ to efficiently decode a stereo signal or a multi-channel signal by applying the parametric stereo method or the parametric multi-channel method.

In operation 1950, it is determined whether a frame decoded in operations 1910 through 1940 is a last frame. If it is determined in operation 1950 that the decoded frame is not the last frame, operations 1910 through 1940 are performed on a subsequent frame.

In addition to the above described embodiments, embodiments of the present general inventive concept can also be implemented through computer readable code/instructions in/on a medium, e.g., a computer readable recording medium, to control at least one processing element to implement any of the above described embodiments. The medium can correspond to any medium/media permitting the storing and/or transmission of the computer readable code.

The present general inventive concept can also be embodied as computer-readable codes on a computer-readable medium. The computer-readable medium can include a computer-readable recording medium and a computer-readable transmission medium. The computer-readable recording medium is any data storage device that can store data as a program which can be thereafter read by a computer system. Examples of the computer-readable recording medium include read-only memory (ROM), random-access memory (RAM), CD-ROMs, magnetic tapes, floppy disks, and optical data storage devices. The computer-readable recording medium can also be distributed over network coupled computer systems so that the computer-readable code is stored and executed in a distributed fashion. The computer-readable transmission medium can transmit carrier waves or signals (e.g., wired or wireless data transmission through the Internet). Also, functional programs, codes, and code segments to accomplish the present general inventive concept can be easily construed by programmers skilled in the art to which the present general inventive concept pertains.

While aspects of the present general inventive concept has been particularly illustrated and described with reference to differing embodiments thereof, it should be understood that these exemplary embodiments should be considered in a descriptive sense only and not for purposes of limitation. Descriptions of features or aspects within each embodiment should typically be considered as available for other similar features or aspects in the remaining embodiments.

Thus, although a few embodiments of the present general inventive concept have been illustrated and described, it would be appreciated by those of ordinary skill in the art that changes may be made to these embodiments without departing from the principles and spirit of the general inventive concept, the scope of which is defined in the claims and their equivalents.

What is claimed is:

1. A method of decoding a signal, the method comprising:

decoding a signal that has been encoded, by using either an ACELP (algebraic code excited linear prediction) mode or a TCX (Transform coded excitation) mode;

generating a high-frequency band signal by using the decoded signal; and upmixing a down mixed mono signal including the decoded signal and the generated high-frequency band signal to a stereo signal, by using one or more spatial parameters, wherein the upmixing is performed by using the spatial parameter generated based on each bitrate mode of at least two bitrate modes.

2. The method of claim 1, wherein the upmixing comprises decoding the down-mixed mono signal according to a parametric stereo method or a parametric multi-channel method.

3. The method of claim 1, wherein the generating of the high-frequency band signal is performed at a constant bitrate (CBR).

4. The method of claim 1, further comprising detecting a bitrate or coding mode applied to encode the spatial parameters or the signal.

5. The method of claim 1, wherein the generating of the high-frequency band signal is performed at a variable bitrate (VBR).

6. The method of claim 1, wherein the decoding of the signal comprises decoding the signal at a multi-bitrate.

7. The method of claim 1, further comprising:

decoding a target bitrate;

calculating residual bits remaining from bits corresponding to the target bitrate, excluding bits used to encode the spatial parameters; and selecting a bitrate or decoding mode corresponding to the bitrate or coding mode applied to encode the signal, in consideration of the residual bits, wherein the decoding of the signal comprises decoding the signal according to the selected bitrate or decoding mode.

8. The method of claim 1, wherein the spatial parameters comprise at least one of a difference between energy level of channels, and a correlation or coherence between the channels.

* * * * *